US009511605B2

(12) United States Patent
Barnett et al.

(10) Patent No.: US 9,511,605 B2
(45) Date of Patent: Dec. 6, 2016

(54) HIGH HEIGHT INK JET PRINTING

(71) Applicant: FUJIFILM Dimatix, Inc., Lebanon, NH (US)

(72) Inventors: Daniel W. Barnett, Plainfield, NH (US); Steven H. Barss, Wilmot Flat, NH (US); Jaan T. Laaspere, Norwich, VT (US); Christoph Menzel, New London, NH (US); Matthew Aubrey, White River Junction, VT (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 0 days.

(21) Appl. No.: 14/748,934

(22) Filed: Jun. 24, 2015

(65) Prior Publication Data

US 2015/0375543 A1 Dec. 31, 2015

Related U.S. Application Data

(60) Provisional application No. 62/018,244, filed on Jun. 27, 2014, provisional application No. 62/075,470,
(Continued)

(51) Int. Cl.
*B41J 2/215* (2006.01)
*B41J 2/165* (2006.01)
(Continued)

(52) U.S. Cl.
CPC ..... *B41J 25/308* (2013.01); *B41J 2/04516* (2013.01); *B41J 2/1714* (2013.01); *B41J 2/215* (2013.01); *B41J 2002/16555* (2013.01)

(58) Field of Classification Search
CPC ..... B41J 2/215; B41J 2/16517; B41J 2/16532; B41J 2/1714; B41J 2002/16555; B41J 2002/1853; B41J 2202/02
See application file for complete search history.

(56) References Cited

U.S. PATENT DOCUMENTS 4,923,743 A 5/1990 Stewart, Jr.
5,877,788 A 3/1999 Haan et al.
(Continued)

FOREIGN PATENT DOCUMENTS

DE 19926464 12/2000
EP 2384894 B1 4/2014
(Continued)

OTHER PUBLICATIONS

PCT International Search Report and Written Opinion of the International Searching Authority, PCT/US2015/037390, Sep. 23, 2015, 19 pages.
(Continued)

*Primary Examiner* — Geoffrey Mruk
(74) *Attorney, Agent, or Firm* — Fish & Richardson P.C.

(57) ABSTRACT

A system includes a print head including multiple nozzles formed in a bottom surface of the print head. The nozzles are configured to eject a liquid onto a substrate. The system includes a gas flow module configured to provide a flow of gas through a gap between the bottom surface of the print head and the substrate. The gas flow module can include one or more gas nozzles configured to inject gas into the gap. The gas flow module can be configured to apply a suction to the gap.

35 Claims, 41 Drawing Sheets

Related U.S. Application Data filed on Nov. 5, 2014, provisional application No. 62/105,413, filed on Jan. 20, 2015.

(51) Int. Cl.

| | |
|---|---|
| ***B41J 25/308*** | (2006.01) |
| ***B41J 2/045*** | (2006.01) |
| ***B41J 2/17*** | (2006.01) |

(56) References Cited

U.S. PATENT DOCUMENTS

| | | | | |
|---|---|---|---|---|
| 6,382,763 | B1 | 5/2002 | Albuquerque et al. | |
| 6,450,628 | B1 | 9/2002 | Jeanmaire et al. | |
| 6,454,384 | B1 | 9/2002 | Peeters et al. | |
| 6,491,362 | B1 | 12/2002 | Jeanmaire | |
| 6,866,370 | B2 | 3/2005 | Jeanmaire | |
| 6,908,178 | B2 | 6/2005 | Jeanmaire | |
| 8,262,192 | B2 * | 9/2012 | Matsumoto | B41J 2/04 347/102 |
| 8,287,116 | B2 | 10/2012 | Cofler | |
| 8,382,243 | B2 | 2/2013 | Miller et al. | |
| 8,596,742 | B2 | 12/2013 | Leoni et al. | |
| 2002/0157252 | A1 | 10/2002 | Silverbrook | |
| 2007/0076043 | A1 | 4/2007 | Aoyama et al. | |
| 2007/0222812 | A1 | 9/2007 | Tokuno et al. | |
| 2008/0308037 | A1 | 12/2008 | Bulovic et al. | |
| 2011/0181639 | A1 * | 7/2011 | Leoni | B41J 11/005 347/9 |
| 2013/0208036 | A1 | 8/2013 | Forrest | |
| 2014/0139589 | A1 | 5/2014 | Ito | |

FOREIGN PATENT DOCUMENTS

| | | |
|---|---|---|
| JP | S5775862 | 5/1982 |
| JP | 2004500265 | 1/2004 |
| JP | 2008221651 | 9/2008 |
| WO | WO2014092678 | 6/2014 |

OTHER PUBLICATIONS

Conedera et al., "New developments in inkjet of deposits carried out under localized extraction or helium," NSTI-Nanotech, vol. 2, published in 2011, 4 pages.

Yang et al., "Research Progress of Aerosol Jet Printing Technology", China Printing and Packing Study, published in 2012, 21 pages.

* cited by examiner

HIGH HEIGHT INK JET PRINTING

CLAIM OF PRIORITY

This application claims priority to U.S. Provisional Application Ser. No. 62/105,413, filed on Jan. 20, 2015; U.S. Provisional Application Ser. No. 62/075,470, filed on Nov. 5, 2014; and U.S. Provisional Application Ser. No. 62/018,244, filed on Jun. 27, 2014, the contents of all of which are incorporated herein by reference in their entirety.

BACKGROUND

Ink jet printing can be performed using an ink jet print head that includes multiple nozzles Ink is introduced into the ink jet print head and, when activated, the nozzles eject droplets of ink to form an image on a substrate. Ink jet printing at an elevated height above the substrate can be used to print onto substrates with large variations in height.

SUMMARY

In a general aspect, a system includes a print head including multiple nozzles formed in a bottom surface of the print head. The nozzles are configured to eject a liquid onto a substrate. The system includes a gas flow module configured to provide a flow of gas through a gap between the bottom surface of the print head and the substrate in a direction corresponding to a motion of the substrate relative to the print head.

Embodiments can include one or more of the following features.

The gas flow module includes one or more gas nozzles configured to inject gas into the gap. In some cases, the one or more gas flow nozzles are interleaved with the nozzles. In some cases, the one or more gas flow nozzles include an elongated nozzle. In some cases, the elongated nozzle is disposed at an angle of about 0-45° to the nozzle plate or about 45-90° to a direction that is perpendicular to a direction of motion of the substrate. In some cases, a width of the elongated nozzle is between about 1-8 mm. In some cases, each elongated nozzle is disposed substantially parallel to a row of the nozzles formed in the bottom surface of the print head. In some cases, at least one of the gas flow nozzles includes multiple holes.

The gas flow module is a first gas flow module. The system includes a second gas flow module. The first gas flow module is configured to provide a flow of gas through the gap in a first direction and the second gas flow module is configured to provide a flow of gas through the gap in a second direction opposite the first direction. The system includes a first valve configured to enable the first gas flow module to provide a flow of gas through the gap; and a second valve configured to enable the second gas flow module to provide a flow of gas through the gap. The first gas flow module includes a first suction module positioned on a first side of the print head and configured to apply suction to the gap. The second gas flow module includes a second suction module positioned on a second side of the print head opposite the first side and configured to apply suction to the gap.

The gas flow module is positioned to provide the flow of gas in a direction substantially corresponding to a direction in which the nozzles eject the liquid onto the substrate.

The gas flow module is configured to provide a flow of gas for each of multiple print heads.

The gas flow module includes a connector configured to receive the gas from a gas source.

The gas flow module is configured to provide a flow of low density gas through the gap. In some cases, the low density gas includes helium.

The gas flow module is positioned upstream of the nozzles.

The gas flow module is configured to apply a suction to the gap.

The gas flow module is positioned downstream of the nozzles. In some cases, the gas flow module is positioned such that a gas flow path through the gas flow module is lower than a gas flow path through the gap. In some cases, the gas flow module is wider than a bottom surface of the print head. In some cases, a lateral edge of the gap is sealed along at least a portion of the print head.

The gas flow module is a first gas flow module positioned upstream of the nozzles. The system includes a second gas flow module positioned downstream of the nozzles.

The gas flow module is a first gas flow module configured to inject a gas into the gap. The system includes a second gas flow module configured to apply a suction to the gap.

The gap between the bottom surface of the print head and the substrate is at least about 3 mm, such as at least about 5 mm.

The system includes one or more of an inlet baffle disposed at an entrance to the gap or an outlet baffle disposed at an exit from the gap. In some cases, a length of the inlet baffle, the outlet baffle, or both is at least five times greater than a height of the gap between the bottom surface of the print head and the substrate.

The system includes a suction generator configured to apply a suction to a back side of the substrate.

The gas flow module is configured to provide a flow of gas at a velocity of between about 0.25 m/s and about 1.5 m/s in a region of the gap substantially at a midpoint between the bottom surface of the print head and the substrate.

The gas flow module is configured to provide a flow of gas at a velocity having a uniformity within 20% along a length of the print head.

The gas flow module comprises a diffuser through which the gas flows prior to entering the gap. In some cases, the diffuser comprises a serpentine channel or a porous material.

In a general aspect, a system includes a print bar configured to receive multiple print heads. The print heads are configured to print a liquid onto a substrate. The system includes a gas flow module configured to provide a flow of gas through a gap between a bottom surface of each print head and the substrate in a direction corresponding to a motion of the substrate relative to the print head.

Embodiments can include one or more of the following features.

The system includes the multiple print heads attached to the print bar.

The print bar includes a non-printing region between an edge of the print bar and a location on the print bar configured to receive an outermost print head.

The gas flow module includes an elongated nozzle.

The gas flow module is formed in the print bar.

The gas flow module is configured to inject a gas into the gap.

The gas flow module is configured to apply a suction to the gap.

The gas flow module is a first gas flow module positioned upstream of the print heads. The system includes a second gas flow module positioned downstream of the print heads.

The gas flow module is a first gas flow module configured to inject a gas into the gap. The system includes a second gas flow module configured to apply a suction to the gap.

The gas flow module is configured to provide a flow of gas at a velocity having a uniformity within 20% along a length of the print bar.

The gas flow module is positioned such that a gas flow path through the gas flow module is lower than a gas flow path through the gap.

The gas flow module is wider than a bottom surface of the print bar.

A lateral edge of the gap is sealed along at least a portion of the print bar.

The system includes multiple print bars and multiple gas flow modules, wherein each gas flow module corresponding to one of the multiple print bars.

In a general aspect, a method includes providing a flow of low density gas through a gap between a bottom surface of a print head and a substrate; and ejecting a liquid through the gap and onto the substrate from multiple nozzles formed in the bottom surface of the print head.

Embodiments can include one or more of the following features.

The low density gas includes helium.

Providing the low density gas includes flowing the low density gas through the gap. In some cases, the method includes flowing the low density gas in a direction corresponding to a motion of the substrate relative to the print head. In some cases, the method includes flowing the low density gas through one or more of an inlet baffle disposed at an entrance to the gap or an outlet baffle disposed at an exit from the gap.

Providing the low density gas includes injecting the low density gas from one or more gas nozzles into the gap.

Providing the low density gas includes disposing the bottom surface of the print head in an environment containing the low density gas.

The method includes applying a suction to the gap.

The method includes applying a suction to a back side of the substrate.

Providing a flow of gas includes providing a flow of gas at a velocity of between about 0.25 m/s and about 1.5 m/s in a region of the gap substantially at a midpoint between the bottom surface of the print head and the substrate.

Providing a flow of gas includes providing a flow of gas at a velocity having a uniformity within 20% along a length of the print head.

Providing a flow of gas through the gap includes providing a flow of gas in a first direction through the gap when the print head moves in the first direction relative to the substrate; and providing a flow of gas in a second direction through the gap when the print head moves in the second direction relative to the substrate, the second direction opposite the first direction.

The approaches described here can have one or more of the following advantages. The occurrence of imaging defects caused by unsteady air flows under the print head (e.g., wood-grain defects) can be reduced. The occurrence of sustainability defects resulting from accumulation of ink on the nozzle plate can be reduced. The time to reach a steady state printing condition can be reduced.

Other features and advantages are apparent from the following description and from the claims.

BRIEF DESCRIPTION OF DRAWINGS

The patent or application file contains at least one drawing executed in color. Copies of this patent or patent application publication with color drawing(s) will be provided by the Office upon request and payment of the necessary fee

DETAILED DESCRIPTION

We describe here an approach to ink jet printing that can mitigate various printing defects that occur when printing with a large separation between an ink jet print head and a substrate (referred to as high height ink jet printing). For instance, the occurrence of various types of defects can be reduced by providing a downstream suction or an upstream flow of gas, such as air or a low density gas such as helium, in the gap between the print head and the substrate. This suction or flow of forced gas can help to stabilize the pattern of gas flow in the gap, thus helping to control the displacement of drops ejected from the print head.

Figure 1:
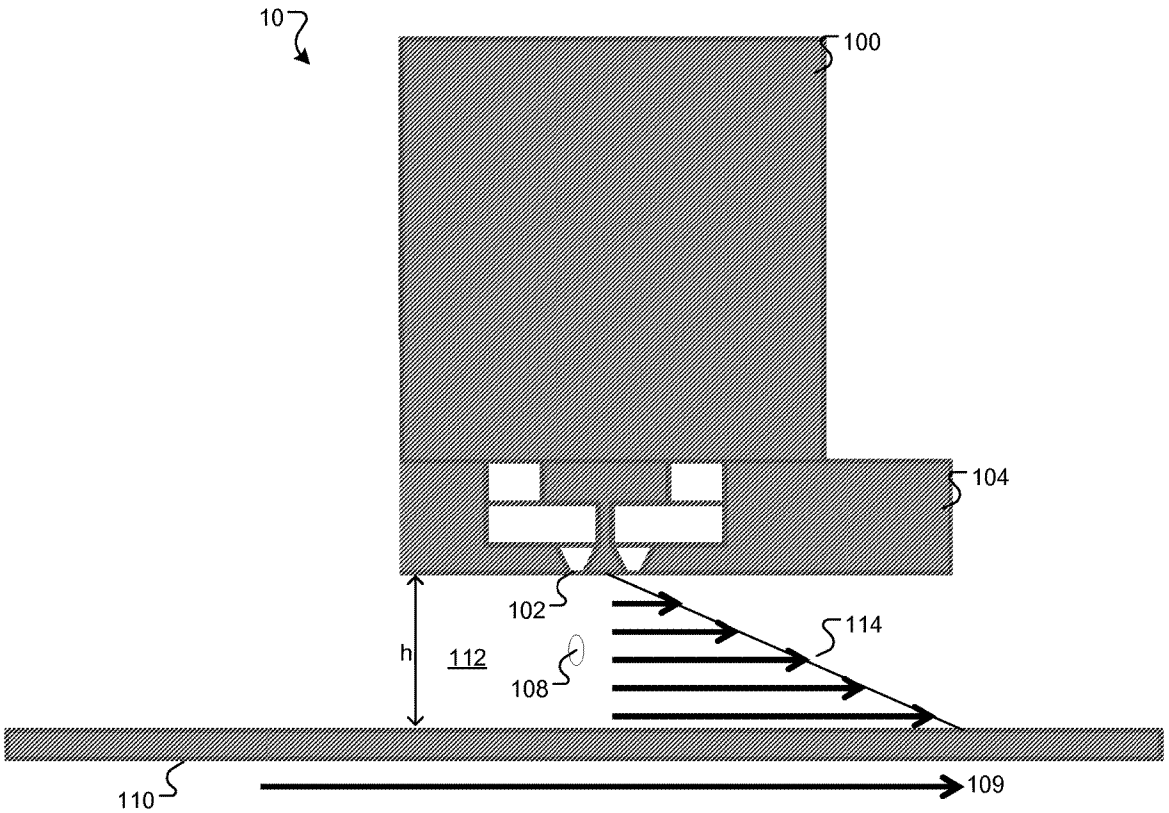
FIG. 1 is a diagram of an ink jet printing system.
Figure 2:
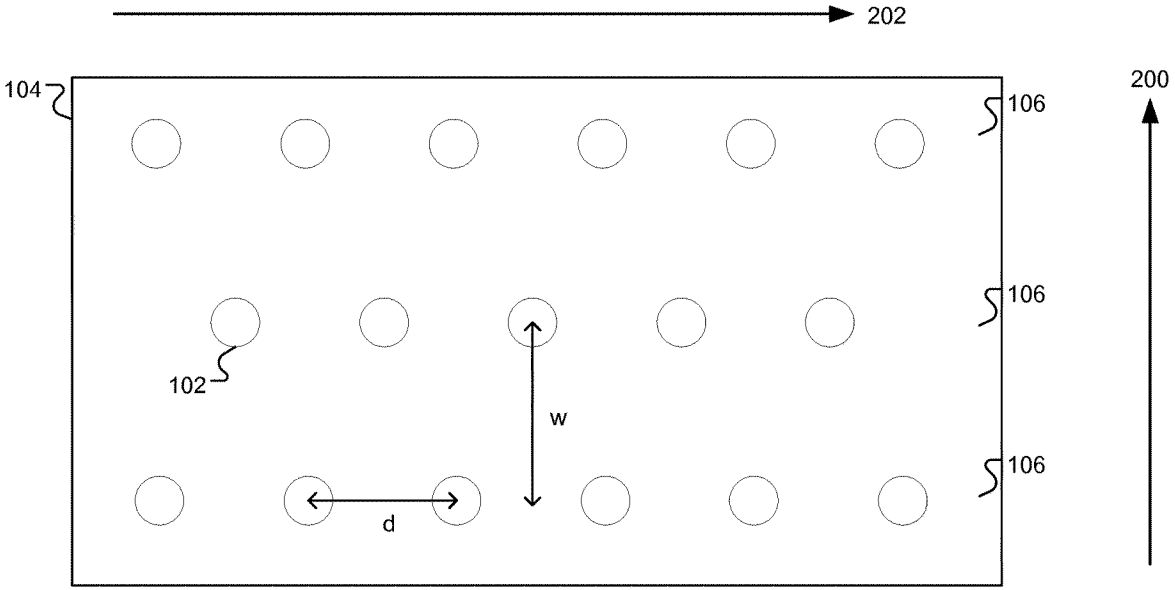
FIG. 2 is a diagram of a nozzle plate.

FIGS. 1 and 2 show an example of an ink jet printing system 10 that includes an ink jet print head 100 capable of printing an image onto a substrate 110. The print head 110 includes multiple nozzles 102 arranged in a nozzle plate 104 on the bottom surface of the print head 100. For instance, the nozzles 102 can be arranged in multiple rows 106 in the nozzle plate 104. Ink drops 108 are jetted from one or more of the nozzles 102, through a gap 112 between the nozzle plate 104 and the substrate 110, and onto the substrate 110 to form a printed image on the substrate 110. In some cases, the substrate 110 moves relative to the print head 100 during the printing process, e.g., as indicated by the arrow 109, while the print head 100 remains stationary. In some cases, the substrate 110 remains stationary and the print head 100 moves relative to the substrate 110. In some cases, both the substrate 110 and the print head 100 move.

The resolution of the ink jet printing system 10 in the process direction, which is the direction in which the substrate 110 or the print head 100 moves during printing can be affected by factors such as one or more of the jetting frequency, velocity of substrate relative to the print head and the number of nozzles per unit of distance in the process direction, or other factors. In the cross-process direction, which is orthogonal to the process direction, the resolution is the number of nozzles per unit of distance in the cross process direction. For instance, FIG. 2 shows a view of the bottom surface of the nozzle plate 104. In the example of FIG. 2, the process direction (indicated by an arrow 200) is orthogonal to the rows 106 of nozzles 102 and the cross-process direction (indicated by an arrow 202) is parallel to the rows 106. In some examples, the process direction and the cross-process direction can have different orientations relative to the rows 106 of nozzles 102. The process direction 200 is parallel to the direction of the arrow 109 (FIG. 1) and the cross-process direction 202 is perpendicular to the direction of the arrow 109 and also perpendicular to the plane of the page in FIG. 1.

Ink jet printing can be performed with the print head 100 positioned at a high height above the substrate 110. For instance, a height h of the gap 112 can be greater than about 2 mm, greater than about 3 mm, greater than about 5 mm, or at another height. The height h of the gap 112 is the vertical distance between the bottom surface of the nozzle plate 104 and a top surface of the substrate 110. We sometimes refer to this approach as "high height ink jet printing" and the height h is sometimes referred to as the "standoff." High height ink jet printing can have various technological applications. In some examples, high height ink jet printing can be used to print onto a substrate that has significant height variations on its surface. In some examples, high height ink jet printing can be used to protect the print head from objects striking the print head, such strikes from loose fibers during printing on textiles.

In high height ink jet printing, the quality of the image printed onto the substrate can be affected by the pattern of gas flow in the gap 112 between the nozzle plate 104 and the substrate 110. For instance, gas flow patterns can give rise to defects in the image printed on the substrate 110. The pattern of gas flow can be influenced by couette flow of gas in the gap 112, by the effects of high frequency jetting of streams of ink drops from the nozzles 102, or by interactions between these two factors. Couette flow is the laminar flow of gas in the gap 112 caused by the velocity difference between the print head 100 and the substrate 110. For instance, when the substrate moves along the direction of the arrow 109 during the printing process, a laminar flow of gas is established, as indicated by the set of arrows 114. The gas at the interface with the substrate 110 moves with a velocity that is substantially equal to the velocity of the substrate, the gas at the interface with the stationary print head 100 has zero velocity, and a substantially linear velocity gradient exists between the print head 100 and the substrate 110. The pattern of gas flow can also be influenced by the drag on successive drops 108 of ink ejected from the print head 100 as the drops travel through the gap 112 and onto the substrate 110.

One or more satellite drops can be formed when the tail of an ejected ink drop 108 breaks off during flight. Satellite drops have low mass, and thus low momentum, which causes them to rapidly decrease in velocity as they are subjected to drag forces during flight. As the velocity of the satellite drops decreases, the momentum of the satellite drops continues to decrease, causing the satellite drops to become susceptible to displacement by the gas flow in the gap 112. In some cases, displacement of satellite drops can lead to defects in printed images. The large ink drop that remains after the satellite drops have broken off is referred to as the native drop (sometimes also called the main drop). The native drop has a larger mass and a higher velocity than the satellite drops, and as such can be less susceptible to displacement by the gas flows in the gap 112. In some cases, displacement of native drops can lead to defects in printed images.

Figure 3:
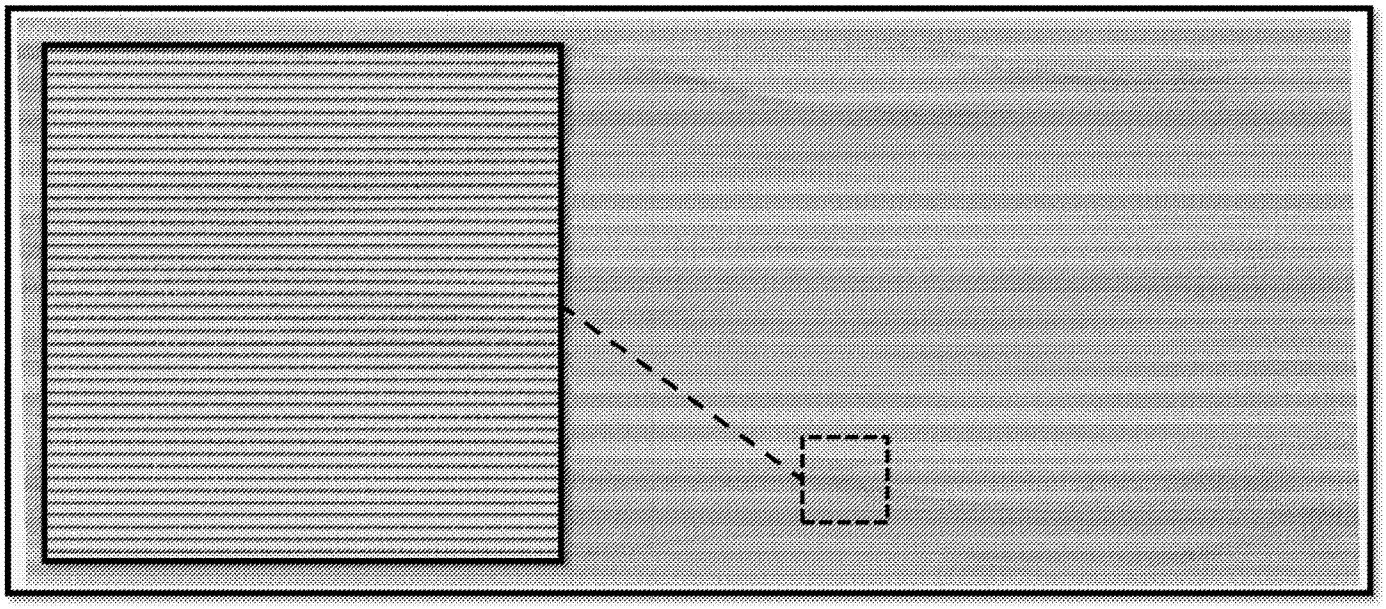
FIG. 3 is an example satellite drop wood grain defect.

In high height ink jet printing, gas flow patterns in the gap 112 can sometimes induce wood grain defects in images printed onto the substrate 110. Without being bound by theory, wood grain defects are believed to be caused by unsteady laminar gas flows that develop in the gap 112 due to interactions between the couette flow entrained by the motion of the substrate 110 or the print head 100 and the air flow entrained by the drag on successive drops of ink 108. The interaction between these two flows has been observed to lead to eddies upstream of the drops 108. The rotational motion of the eddies enables the eddies to easily move along the stream of drops in the gap 110 and develop into localized larger eddies. These unsteady flows and localized eddies can cause small, concentrated drop placement errors, e.g., errors typically ranging from about 10 microns to about 2 mm, in which ink drops group together in certain areas of the printed image to form a pattern that looks like a wood grain. An example of a satellite drop wood grain defect in an array of printed lines is shown in FIG. 3. When printing at low cross-process resolution (e.g., less than or equal to 100 dpi) and at lower heights (e.g., h less than about 6 mm), wood grain defects are believed to be caused primarily by displacement of satellite drops. When printing at low cross-process resolution at higher heights (e.g., h greater than about 7 mm), wood grain defects are believed to be caused by displacement of both satellite drops and native drops. The height at which native drop wood graining will become more visually dominant over the satellite wood graining can be affected by the drop mass. Native drops that are ejected with lower mass are more easily displaced during flight by air flows in the gap 110 and thus can more readily result in wood grain imaging defects than larger native drops.

Figure 4:
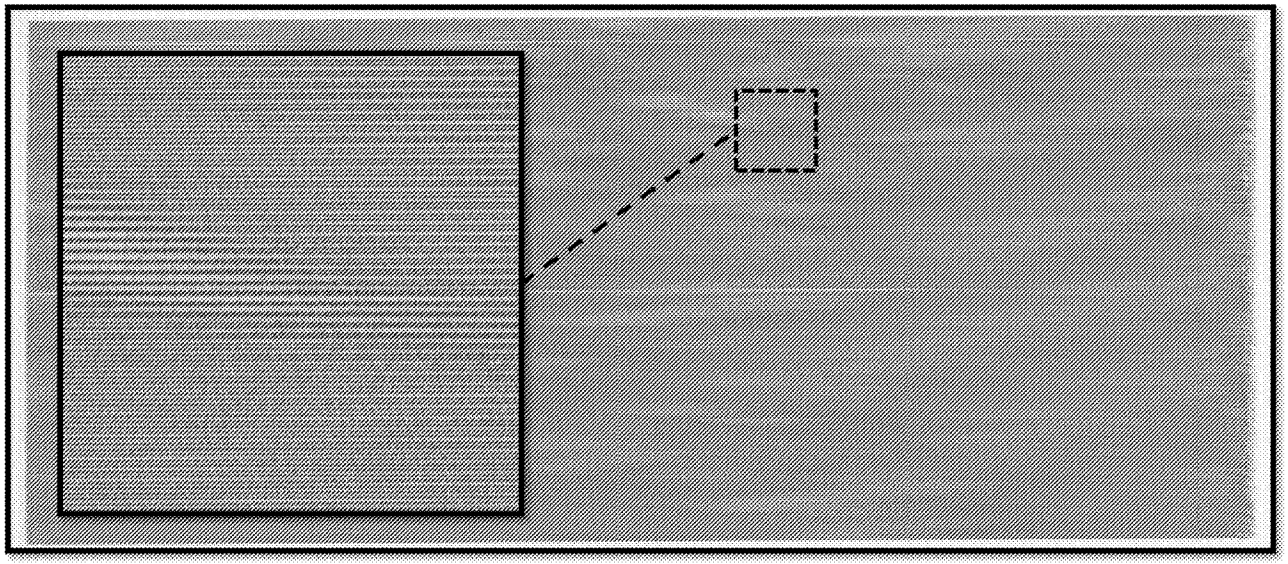
FIG. 4 is an example native drop wood grain defect.

As cross-process resolution increases or as the size of the ejected ink drops 108 increases, the non-printed area between adjacent droplets on the substrate decreases. This decrease in non-printed area enables placement errors to more easily be observed, which can cause native drop wood grain defects to become more visually dominant over satellite wood grain defects at lower heights (e.g., h less than about 6 mm). An example native drop wood grain defect is shown in FIG. 4.

The height h at which wood grain defects and other types of high height printing defects occur can vary based on one or more parameters, such as the native drop size, satellite drop size, the drop velocity, the printing frequency, the nozzle spacing, or other parameters. For instance, the onset of high height printing defects can occur at a lower height when printing with small drops (e.g., less than about 10 ng) than when printing with larger drops (e.g., larger than 10 ng). The onset of high height printing defects can occur at a lower height when printing with a small nozzle spacing within each row (e.g., about 100 nozzles per inch) than when printing with a larger nozzle spacing (e.g., about 50 nozzles per inch).

Figure 5:
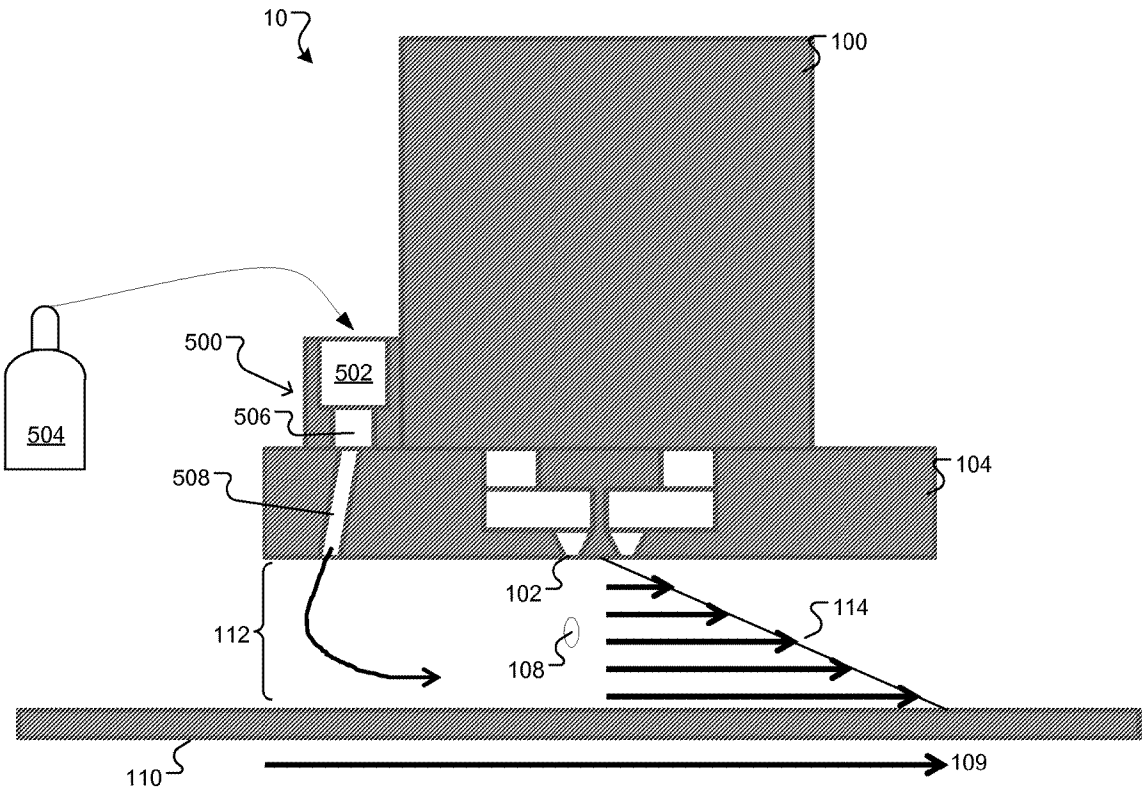
FIG. 5 is a diagram of an ink jet printing system.

Referring to FIG. 5, in some embodiments, a forced gas module 500 injects a gas, such as air, helium, or another gas (e.g., hydrogen or methane gas), to flow through the gap 112 in the direction of the couette flow (e.g., in the direction of the arrows 114). In some examples, the forced gas module 500 is part of the print head 100. In some examples, the forced gas module 500 is a separate module that can be used in combination with the print head 100, e.g., by attaching the forced gas module 500 to the print head or disposing the forced gas module 500 adjacent to the print head. Without being bound by theory, it is believed that forcing gas to flow through the gap 112 can help to stabilize unsteady flows that can cause wood grain defects and other printing defects.

The forced gas module 500 includes a gas supply port 502 that is connected to a gas source. In some cases, the gas source can be the environment. For instance, if the printing system 10 is operated in normal atmosphere, the gas source can be the air. If the printing system 10 is operated in an environment of a gas, such as helium, the gas source can be the helium in the environment (discussed in more detail below). In some cases, the gas source can be a gas supply 504, such as a canister of compressed air, a canister of a low density gas such as helium, or another type of gas supply. The gas supply port 502 supplies the gas to a manifold 506 that distributes the gas to one or more gas nozzles 508, which inject the gas into the gap 112.

In some cases, each gas nozzle 508 can be implemented as a single hole. In some cases, each gas nozzle 508 can be implemented as a mesh of small holes. There can be one gas nozzle 508 (e.g., implemented as a single hole or as a mesh of small holes) for at least every 5 ink jet nozzles 102, e.g., at least every 20 nozzles, at least every 100 nozzles, or a greater number of nozzles. In some examples, there can be one gas nozzle 508 that supplies gas for thousands of ink jet nozzles 102. In some cases, the forced gas module 500 can also include other components, such as filters, screens, or other components for regulating gas flow.

In some cases, the gas nozzles 508 can be positioned upstream of the ink jet nozzles 102 such that the gas injected by the gas nozzles 508 will be entrained under the print head 100 by the motion of the substrate 110 or the print head 100. In some cases, the gas nozzles 508 can be angled towards the ink jet nozzles 102 (e.g., angled downstream) to assist with constraining the eddies which develop under the print head 100. In some cases, the gas nozzles 508 can be substantially parallel to the ink jet nozzles 102 or can angled away from the ink jet nozzles 102.

Without being bound by theory, it is believed that injecting a low density gas, such as helium, can help reduce the unsteady flows in the gap 112. By low density gas, we mean a gas that has a lower density than air at standard ambient temperature and pressure (SATP) (e.g., about 25° C. and about 1 atm). For instance, helium at SATP has a lower density than air. A low pressure environment filled with air (e.g., an environment at 0.8 atm, 0.5 atm, 0.3 atm, or another pressure) has a lower density than air at SATP. The flow of forced helium can stabilize unsteady flows in the gap and thus constrain eddies from becoming unsteady in much the same way as forced air can stabilize flows. In addition, a low density environment can reduce the air that is entrained by droplet drag, thus resulting in smaller and lower velocity eddies. A low density environment can reduce vertical drag during the drop flight from nozzle plate to substrate, thus reducing the reduction of drop velocity and enabling the drops to maintain a higher momentum. A low density environment can cause cross flows under the print head to exert lower horizontal drag forces on the ink which in turn reduces placement errors on the drops.

The breakdown of laminar couette flow and the onset of turbulent flow can be predicted by the Reynolds number Re, which is a dimensionless number given as:

$$Re = \frac{\rho V L}{\mu},$$

where ρ is the density of the gas, V is the velocity of the gas, L is the characteristic length, and μ is the dynamic viscosity of the gas. In the case of flows under print heads, the characteristic length L is typically defined as the height h of the gap 112.

Reynolds numbers below about 2300 typically indicate laminar flow, while Reynolds numbers above about 4000 indicate turbulent flow. While not generally common in ink jet printing applications, it is possible for turbulence to occur under certain conditions (e.g., high height or high velocity flows). The Reynolds number can be decreased by decreasing the ratio of the density of the gas in the gap to the dynamic viscosity of the gas. The inverse of this ratio is defined as the kinematic viscosity:

$$\nu = \frac{\mu}{\rho}.$$

The Reynolds number in the gap can thus be decreased by injecting a gas that has a high kinematic viscosity into the gap. For instance, helium has a kinematic viscosity that is 7 times higher than that of air, and thus injecting helium into the gap can reduce the Reynolds number in the gap by a factor of about 7. With a reduced Reynolds number in the gap, printing can be carried out at higher heights while still reducing the possibility of turbulence in the printing gap.

In some cases, when printing at high heights, the motion of small drops and satellite drops can be affected by drag on the drops by the gas in the gap. Small ink drops are ejected from the print head 100 with low initial momentum due to their low mass, and thus can rapidly decrease in velocity during flight. Similarly, satellite drops have low mass and low velocity when they are created, and thus also have low initial momentum. As the drop velocity decreases, the drops lose additional momentum, making the drops susceptible to displacement by gas flow patterns in the gap 112.

Assuming laminar flow through the gap, the drag force on a drop during flight can be calculated from:

$$F_D = \tfrac{1}{2}\rho V^2 C_D A,$$

where A is the cross-sectional area of the droplet approximated as a sphere and $C_D$ is the Schiller-Naumann drag coefficient:

$$C_D = \frac{24(1 + 0.15\ Re^{0.687})}{Re}.$$

The force of gravity can be considered negligible and from Newton's second law the deceleration rate can be simplified as:

$$a = \frac{F_D}{m} = \frac{\frac{1}{2}\rho V^2 C_D A}{m}.$$

Figure 6:
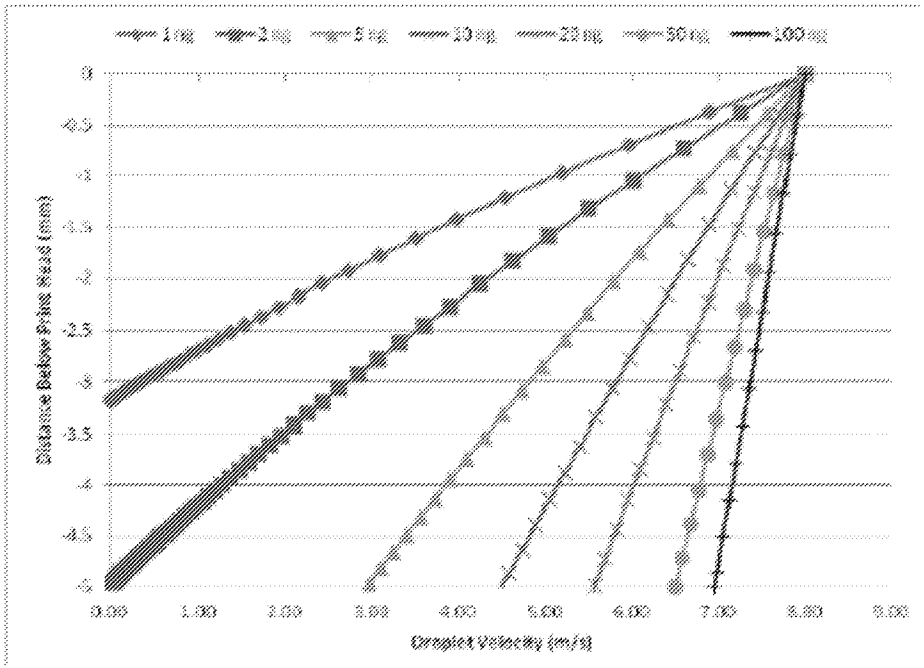
FIG. 6 is a plot of drop velocity as a function of distance below the print head.

Referring to FIG. 6, using these equations, for printing in air, it can be seen that the drop velocity decreases rapidly with distance below the print head, with a particular rapid decrease for drops with mass less than about 10 ng. In computing the graph of FIG. 6, the drag coefficient $C_D$ was reduced by 15% to account for reduction of drag due to the slipstream generated in the gap when jetting a stream of ink drops. This 15% drag reduction was experimentally verified by experimentally monitoring the velocity reduction during flight for 5-10 ng drops and comparing the measured drop velocity to the calculated drop velocity.

Figure 7:
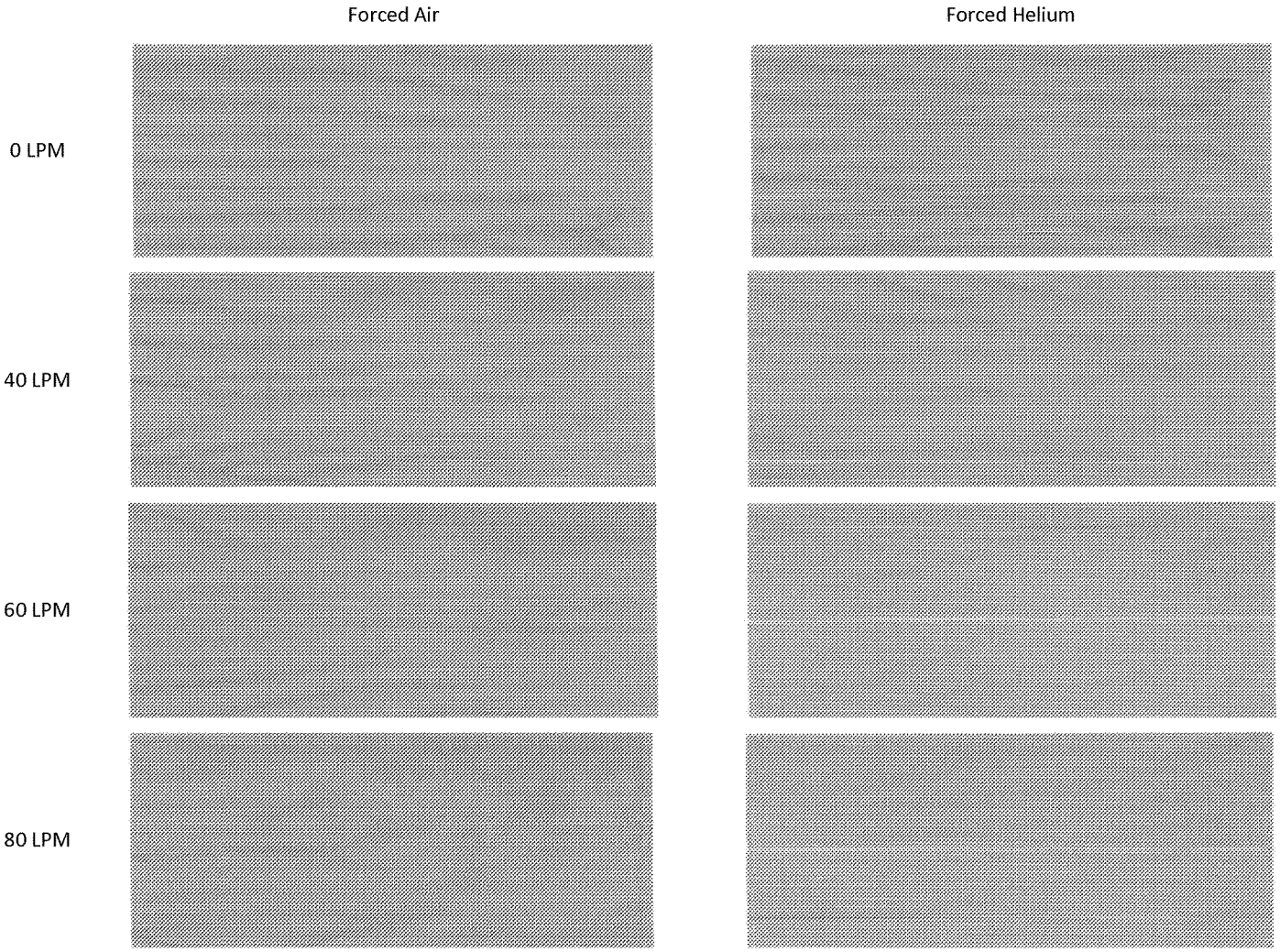
FIG. 7 is a set of images printed using various flow rates of air and helium.

These calculations demonstrate that printing in a low density environment results in a lower Reynolds number which lowers the coefficient of drag for the drops of ink. A lower coefficient of drag in turn lowers the drag force (e.g., vertical drag force, horizontal drag force, or both) experienced by the drops. The effects of drag on small drops and satellite drops can contribute to drop displacements that contribute wood grain and sustainability defects. Forcing a low density gas, such as helium, through the gap can mitigate these defects, as shown in FIG. 7, discussed below. A low density gas has a low Reynolds number, which means the gas exerts a lower drag force on each drop. Reduced drag in turn can lead to higher jetting velocity, which reduces the displacement of small drops and satellite drops and thus leads to higher print quality.

In some examples, the gas nozzles 508 can be sufficient in size, number, or both to provide sufficient velocity of gas to stabilize unsteady flows in the gap 112 without generating disturbances, such as turbulent flow or large variations in air flow velocity, in the gap. The size or number of gas nozzles 508 can also be sufficient to provide a low density printing environment that reduces drag on ink drops, thus preventing the drops from losing velocity and reducing lateral drag forces exerted on the drops during flight. In some examples, the size, number, or both of the gas nozzles 508 is such that less than about 0.5 m/s of gas can stabilize the unsteady flows. In some examples, the velocity of the gas measured during a non jetting condition at or around the midpoint of the gap 112 (e.g., halfway between the print head 100 and the substrate 110) is between about 0.25 m/s and about 1.5 m/s, e.g., between about 0.25 m/s and about 1.0 m/s, e.g., about 0.5 m/s.

The effect of forcing gas into the gap on the occurrence of wood grain defects was tested by injecting air or helium into the gap 112 between the print head 100 and the moving substrate 110. The gas flow was controlled by a mass flow controller (Aalborg® GFC Mass Flow Controller, Orangeburg, N.Y.). An image pattern of 256 lines spaced at 100 dots per inch (dpi) in the cross process direction and 400 dpi in the process direction and 2400 pixels long (6 inches) was printed using various flow rates of air and helium at various standoff heights (h). The images were printed using a black ceramic ink using a QE-30 print head (Fujifilm Dimatix, Lebanon, N.H.). Primary test parameters for these forced gas experiments were as follows:

Cross-process print resolution: 100 dpi
Droplet ejection velocity: 7 m/s
Frequency: 8 kHz
Substrate velocity: 0.5 m/s
Waveform: single 7 μs pulse
Standoff (h): 3.8 mm; 5.1 mm
Gas flow rate: 0 L/min (lpm); 40 lpm; 60 lpm; 80 lpm
Drop mass: 33-43 ng The gas flow rates used in these forced gas experiments are significantly higher than gas flow rates that may be used in industrial applications, e.g., because of excess helium wasted to the ambient environment.

FIG. 7 shows patterns printed from a height of 5.1 mm using various flow rates of air and helium. For printing in either air or helium, wood grain defects were reduced at higher flow rates, indicating that the injection of forced gas into the gap may stabilize the unsteady laminar flows in the gap that can lead to wood grain defects. When printing with forced air, fogging defects were seen at high flow rates (80 lpm), before the wood grain defects had been completely eliminated, indicating that the velocity of forced air was high enough to cause large droplet placement errors due to the severe droplet drag in the process direction. When printing with forced helium, wood grain defects were significantly reduced or eliminated to a greater degree than when printing in air. Similar trends were observed for forced air and forced helium printing at 3.8 mm standoff. These results indicate that forcing gas through the gap 112 can help to reduce wood grain defects, e.g., by controlling unsteady flows that may occur in the gap.

Figure 8:
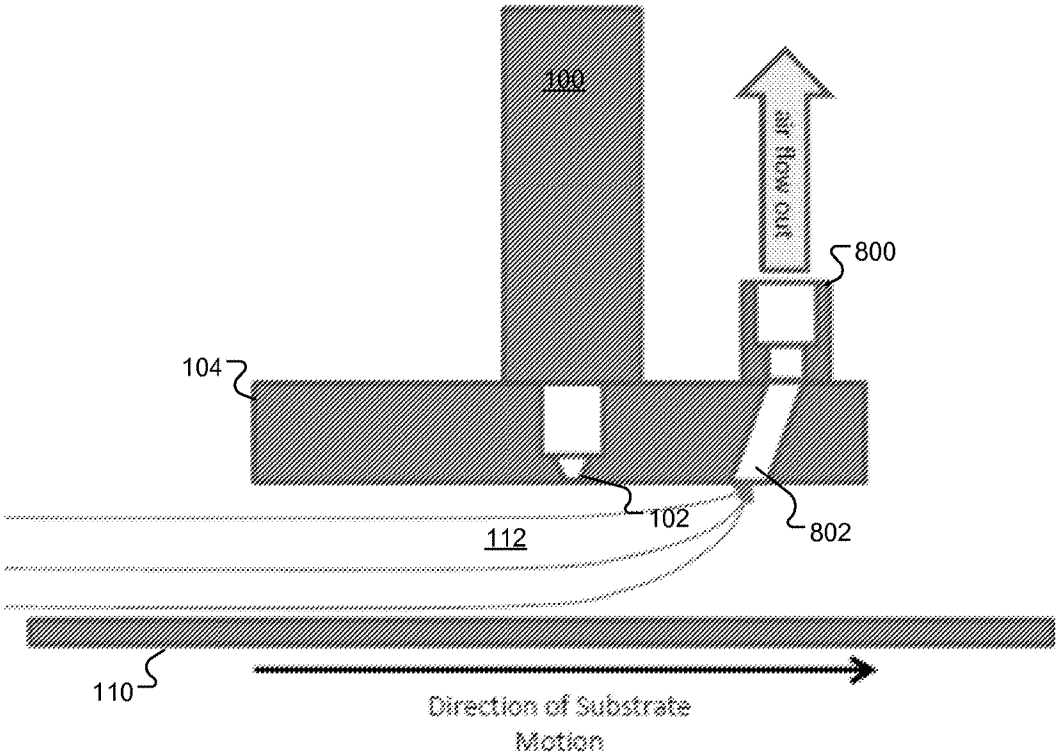
FIGS. 8-10 are diagrams of ink jet printing systems.

Referring to FIG. 8, in some embodiments, a downstream air flow module 800 pulls air out of the gap 112, e.g., by applying a suction through a suction nozzle 802. For instance, a vacuum generator can be used to cause the suction nozzle 802 to apply a suction. In some examples, the downstream air flow module 800 is part of the print head 100. In some examples, the downstream air flow module 800 is a separate module that can be used in combination with the print head 100, e.g., by attaching the downstream air flow module 800 to the print head or disposing the downstream air flow module 800 adjacent to the print head. Experiments have shown that applying suction downstream of the gap 112 can cause a flow of air that can help to stabilize unsteady flows that can cause wood grain defects and other printing defects. In addition, applying a downstream suction can draw satellite drops downstream and out of the gap 112, thus reducing the occurrence of defects such as fogging.

Figure 9:
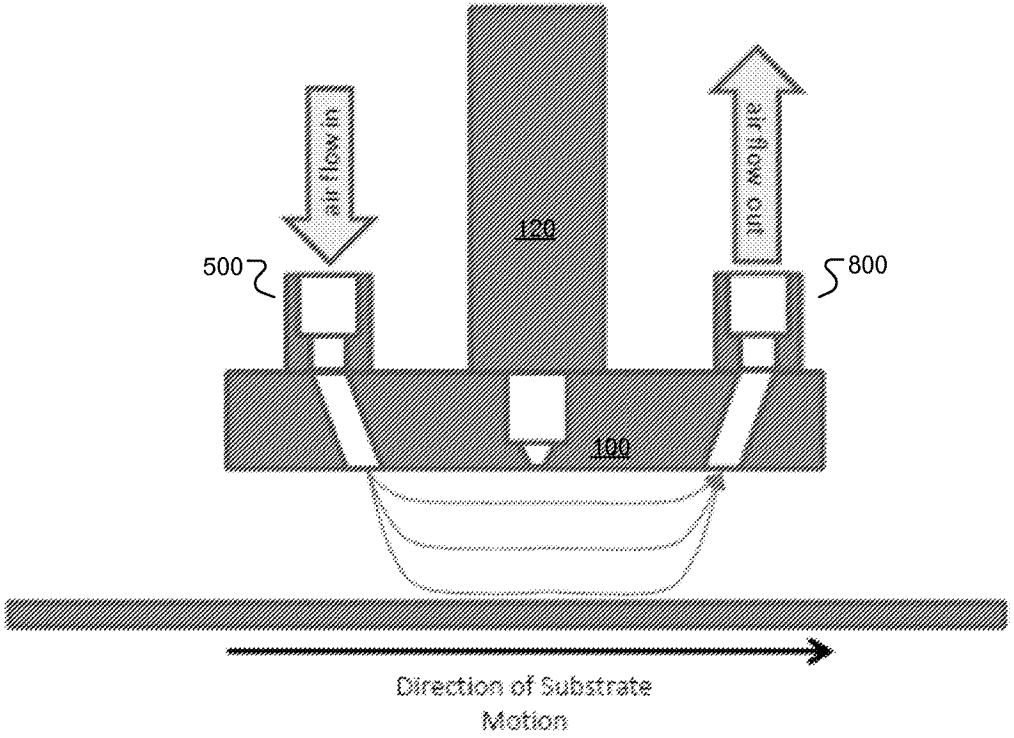

Referring to FIG. 9, in some embodiments, the forced air module 500 and the downstream air flow module 800 can be used together such that the upstream air supply from the forced air module 500 and the downstream suction or vacuum induce a robust air flow through the gap. In the example of FIG. 9, the forced air module 500 and the downstream air flow module 800 are used to provide air flow in the gap below a print bar 120 including one or more print heads 100. In some cases, the suction provided by the downstream air flow module 800 can be the primary determinant of air flow in the gap 112, assisted by upstream forced air injection from the forced air module 500. Using both supply and return ducts (e.g., the forced air module 500 and the downstream air flow module 800) for each print bar can be advantageous when multiple print bars 120 are placed in close proximity to each other. In some examples, dedicated supply and return ducts can ensure that the air flow under each print bar 120 is controlled separately and can help prevent air flow under one print bar 120 from influencing the air flow under a neighboring print bar. In some examples, the air flow under one print bar 120 can be prevented from affecting the air flow under a neighboring print bar by separating the two print bars by a distance sufficient to allow the air to vent between the print bars, such as by a distance of at least about 10 mm, at least about 15 mm, at least about 20 mm, about 20 mm, or another distance. Either or both of the modules 500, 800 can be part of the print head 100 or can be a separate module.

Figure 10:
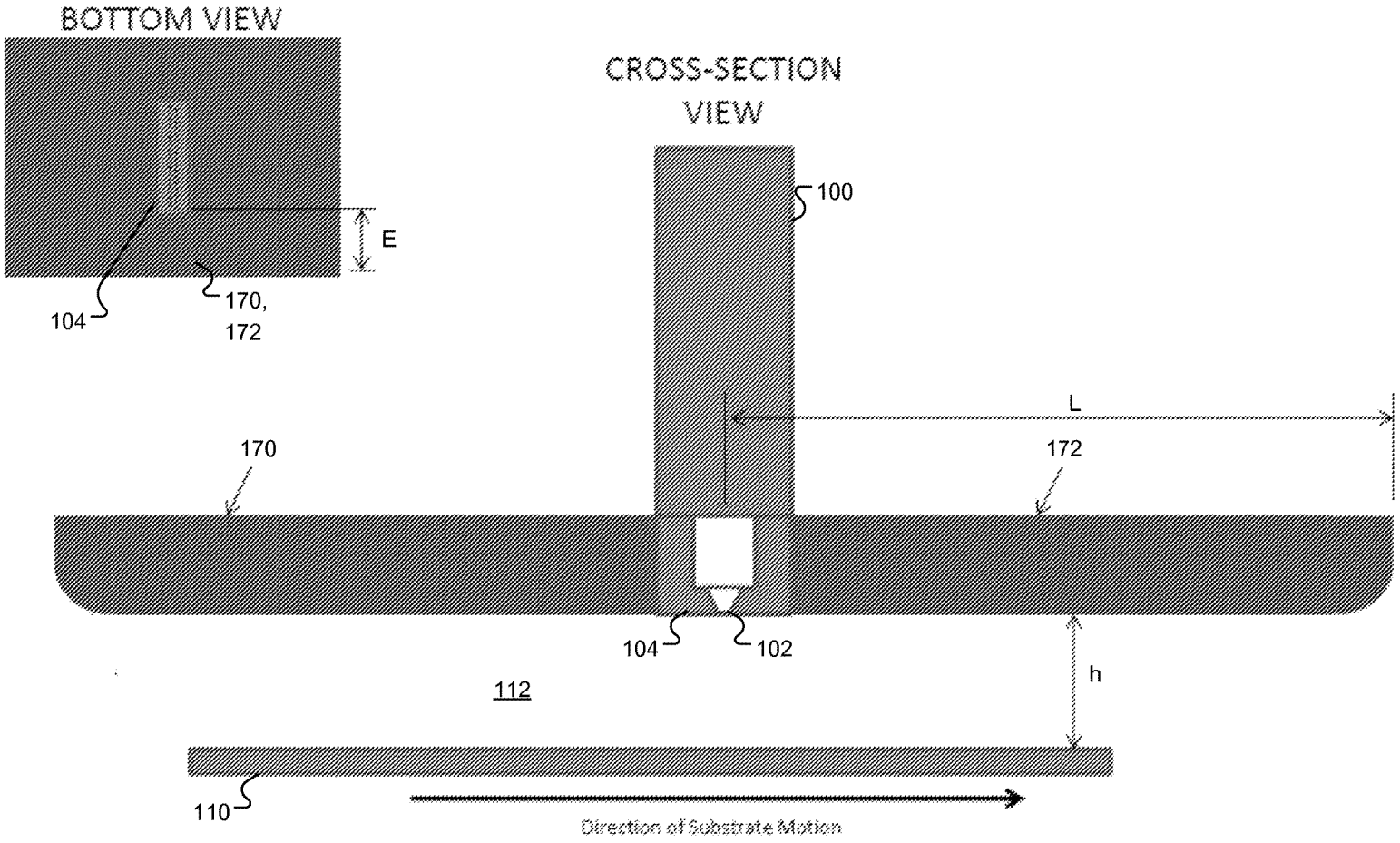

Referring to FIG. 10, in some embodiments, baffles can be provided at the upstream entrance to the gap 112, the downstream exit from the gap 112, or along the sides of the gap. For instance, in the example of FIG. 10, an inlet baffle 170 is provided at the entrance to the gap and an outlet baffle 172 is provided at the exit from the gap. In some cases, the inlet baffle 170, the outlet baffle 172, or both are planar with the surface of the nozzle plate 104, e.g., within ±0.5 mm of the surface of the nozzle plate 104. The length L of the baffles 170, 172 can be greater than the height h of the gap 112, e.g., at least 5 times greater, at least 10 times greater, or more than 10 times greater than the height of the gap 112. The baffles 170, 172 can extend beyond the last nozzle 102 on the print head 100 by an amount E greater than the height h of the gap 112, e.g., at least two times greater than the height of the gap 112, at least 5 times greater, or more than 5 times greater. In some examples, the baffles 170, 172 can have a radius or chamfer r that is approximately equal to or greater than the height h of the gap. Baffles can help to streamline the flow of gas in the gap, thus reducing the possibility of unsteady laminar flows or turbulence in the gap.

Figure 11A:
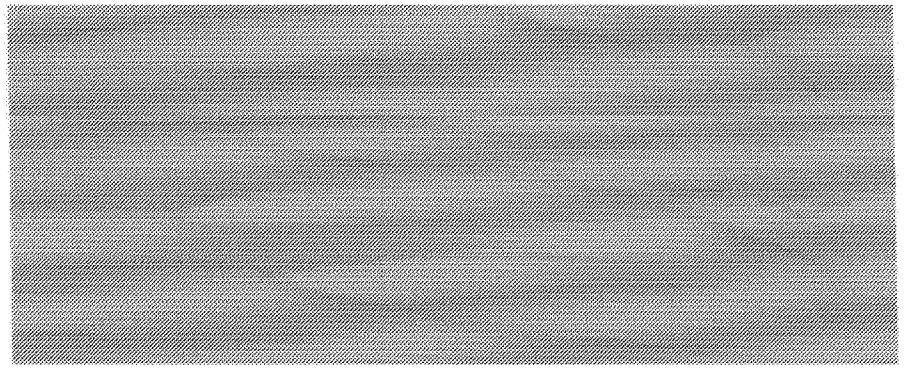
FIGS. 11A, 11B, and 11C are images printed with forced air with no baffles, with an inlet baffle, and with an inlet baffle and an outlet baffle, respectively.
Figure 11B:
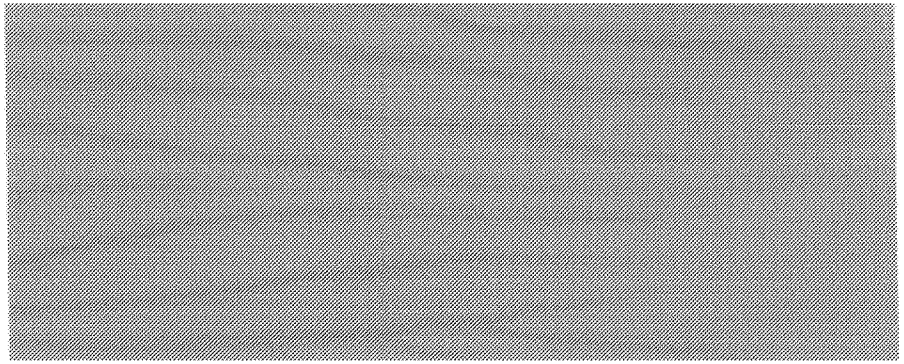
Figure 11C:
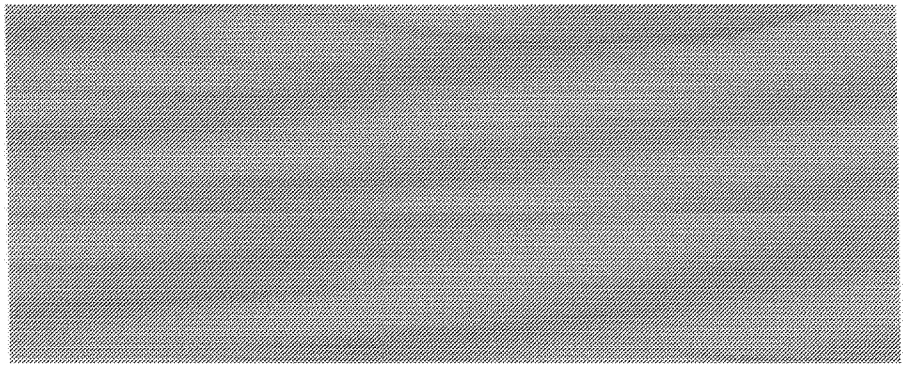

FIGS. 11A-11C show patterns printed with forced air at a standoff of 3.8 mm with no baffles (FIG. 11A), the inlet baffle 172 (FIG. 11B), and the inlet baffle 172 and the outlet baffle 174 (FIG. 11C). Wood-grain defects were reduced slightly by the use of a single inlet baffle and further reduced by the use of both an inlet and an outlet baffle. These results indicate that the presence of baffles can contribute to stabilizing the gas flow in the gap, thus reducing wood grain defects.

Figure 12A:
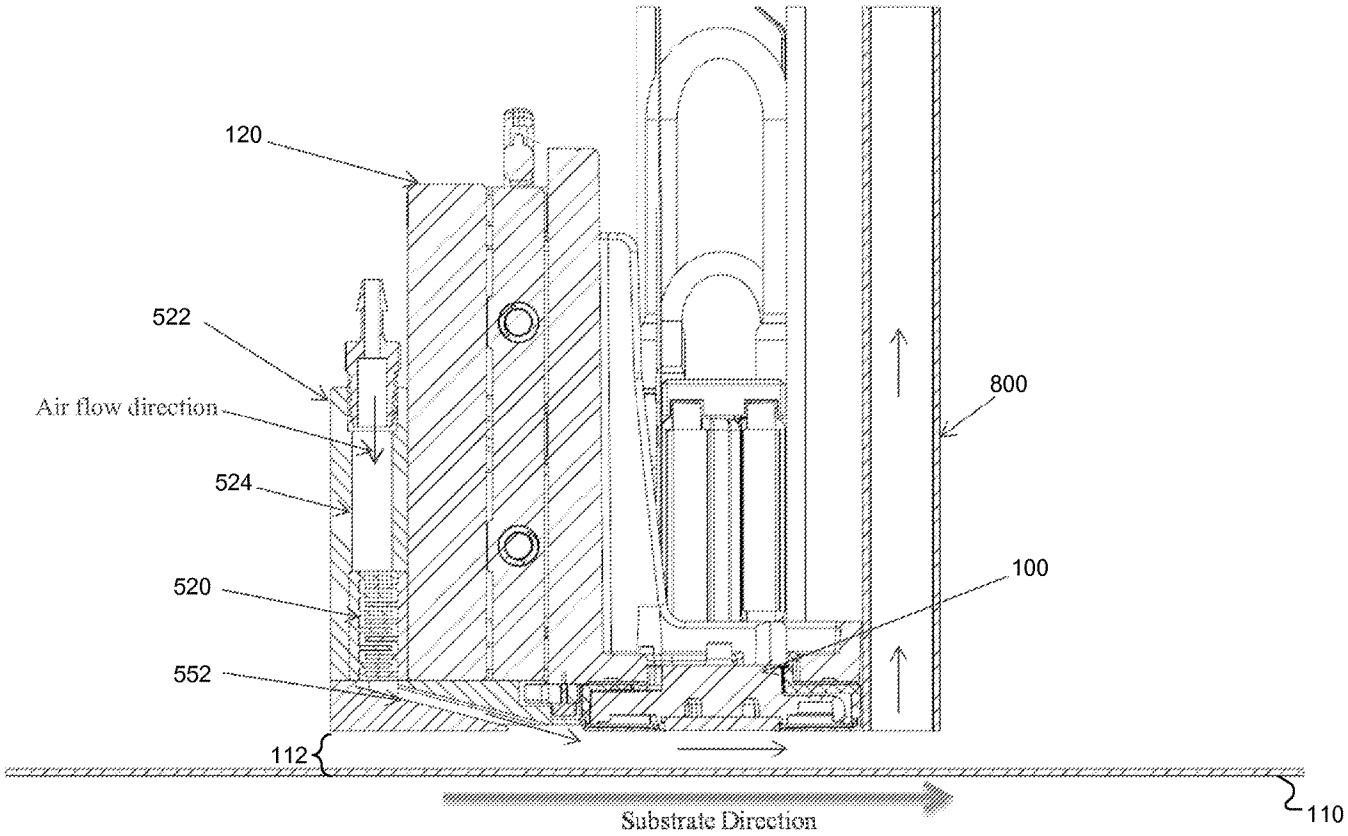
FIGS. 12A and 12B are diagrams of an ink jet printing system.

Referring to FIG. 12A, in some embodiments, the forced gas module 500 includes a diffuser 520 through which the injected gas flows before entering the gap 112 between the print head 100 and the substrate 110. The presence of a diffuser 520 helps to make the velocity of the gas substantially uniform along the length of the print bar 120). For instance, the uniformity of the gas velocity can be, e.g., within about 20% along the length of the print bar 120. The diffuser 520 can be formed toward an inlet end of a gas supply manifold plate 522 of the forced gas module 500. For instance, the air flow from the forced gas module 500 can flow through one or more inlet holes 524 to the diffuser 520. In some examples, the diffuser 520 can be, e.g., a channel, such as a serpentine channel, as shown in FIG. 12A. In some examples, the diffuser 520 can be a porous material, such as porous aluminum or a metallic foam. As the gas flows along the serpentine channel or through the porous material, the gas flow spreads out and becomes diffuse, thus helping to improve the gas flow uniformity in the gap. Any variations in air flow within the gap can cause the air flow to displace some drops more than others. A high degree of uniformity in the gas flow within the gap can thus improve print quality and reduce drop placement errors.

Figure 12B:
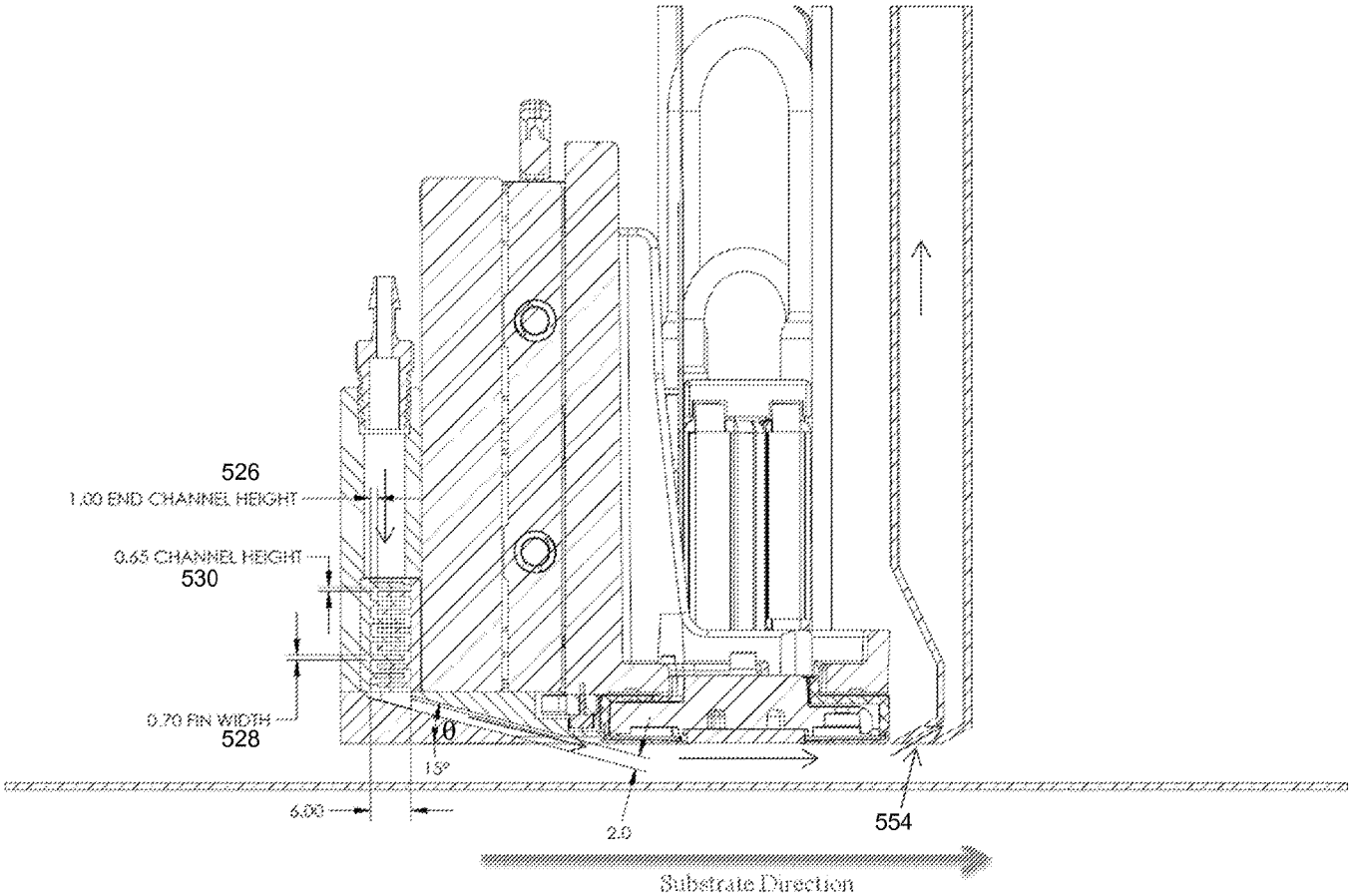

Referring also to FIG. 12B, in some examples, the inlet holes 524 into the diffuser 520 can be spaced apart by a distance of between about 50-200 mm. An inlet channel 526 into the diffuser 520 has a height of about 0.5-2 mm, e.g., about 1 mm. The diffuser 520 can have a width of about 4-15 mm, e.g., about 6 mm. The serpentine channel diffuser 520 can include multiple fins 528, such as between 2-30 fins, e.g., 6 fins or 12 fins. Each fin 528 can be about 0.25-1.5 mm in width, e.g., about 0.7 mm in width, and an air flow channel 530 through the diffuser 520 can have a height of about 0.25-2 mm, e.g., about 0.65 mm.

Figure 13:
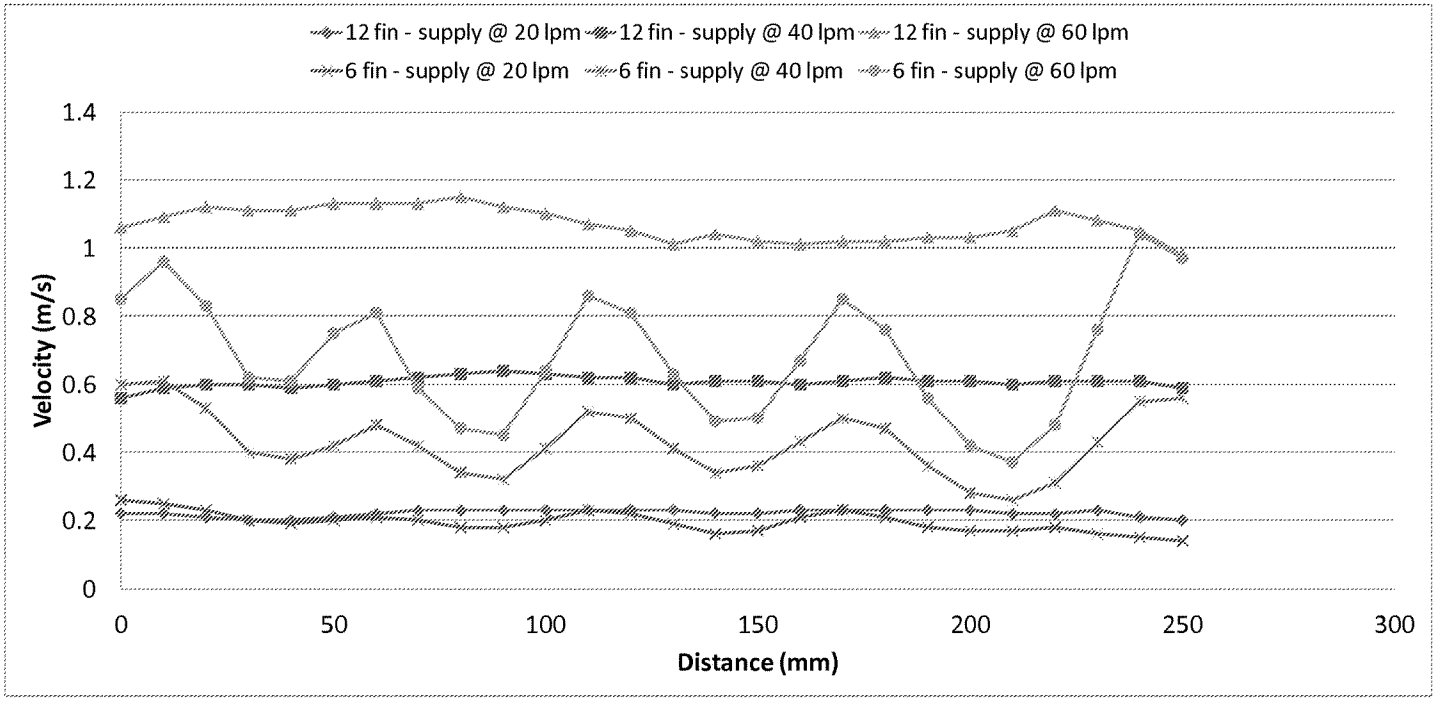
FIG. 13 is a plot of the effect of diffuser structure on air flow velocity.

Referring to FIG. 13, the effect of the number of fins (6 or 12 fins) in the diffuser on the air flow velocity was measured for a 50 mm inlet hole spacing at 20 lpm, 40 lpm, and 60 lpm.

Referring again to FIGS. 12A and 12B, the forced gas module 550 can include a single, elongated slot 552 (which we sometimes refer to as a plenum) that injects gas into the gap between the print head 100 and the substrate 110. The elongated slot 552 can be a rectangular slot, a rounded rectangular slot, an oval or an ellipse slot, or a slot with another elongated shape. The outlet of the elongated slot 552 can be flush with the nozzle plate 104 such that no component of the forced gas module protrudes below the bottom surface of the nozzle plate 104. The dimensions and position of the elongated slot 552 can contribute to controlling the velocity vectors of the air flow in the gap 112 between the print head 100 and the substrate 110. For instance, the elongated slot 552 can be dimensioned and positioned such that the air flow in the gap is substantially parallel to the substrate 110. The width w of the elongated slot can be about 1-8 mm, e.g., about 1-6 mm, e.g., about 1-4 mm, e.g., about 2 mm. In some examples, a wide slot (e.g., greater than about 4 mm) can cause gas flow to be wasted to the ambient environment. In some examples, a narrow slot (e.g., less than about 1 mm) can increase flow non-uniformities. The elongated slot 552 can be positioned at an angle θ relative to the nozzle plate of about 0-45°, e.g., about 10-20°, e.g., about 15°. The elongated slot 552 can be positioned at an angle of about 45-90° to a direction that is perpendicular to the direction of motion of the substrate 110. The elongated slot can be positioned less than about 20 mm away from the nearest nozzle. In some examples, the distance between the slot 552 and the nearest nozzle can be reduced or minimized, e.g., to maintain a narrow print bar width.

Figure 14:
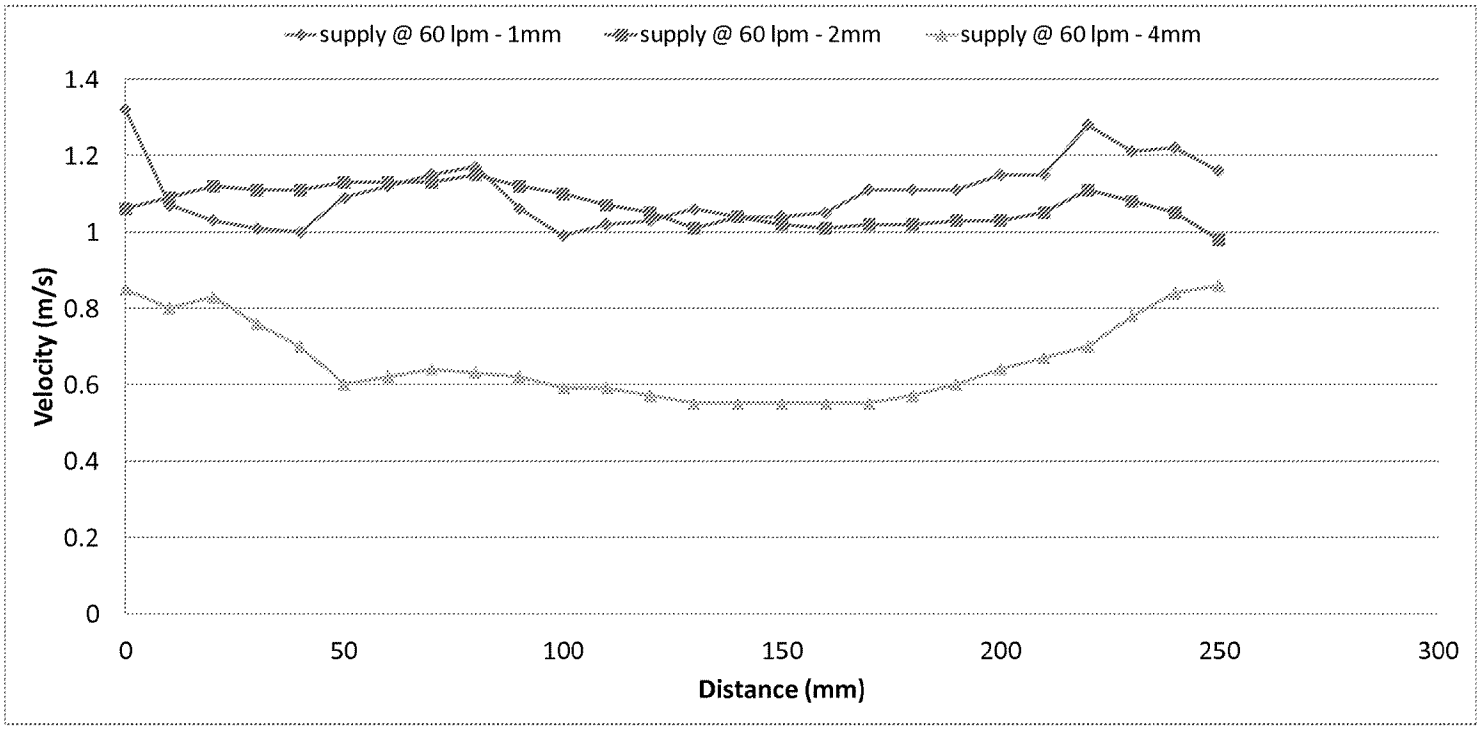
FIG. 14 is a plot of the effect of plenum width on air flow velocity.

Referring to FIG. 14, the effect of the plenum width (1 mm width, 2 mm width, and 4 mm width) on the air flow velocity was measured for a 50 mm inlet hole spacing at 60 lpm using a 300 mm long plenum at a height of 5 mm.

In the example embodiments shown in FIGS. 12A and 12B, the diffuser 520 and the plenum 552 are used together. In some examples, either the diffuser 520 or the plenum 552 can be used independently. In some examples, a diffuser or a plenum or both can be positioned at the outlet end of the gap 112, e.g., as part of the downstream air flow module 800. For instance, in the example of FIG. 12B, the downstream air flow module 800 includes a downstream plenum 554 that can improve the directionality of the gas at the downstream end of the gap 112, thus helping to reduce gas consumption and reduce the potential that the air flow in the gap 112 influences the air flow in the gaps under neighboring print bars. In addition, the air flow provided by the downstream air flow module 800 can collect satellite drops, thus helping to reduce fogging or other defects.

In some examples, the substrate velocity can affect the occurrence of wood grain defects. For instance, moving the substrate at high velocity can induce a stronger couette flow in the gap, thus reducing unsteady flows in the gap and resulting in fewer wood grain defects.

Figures 15A, 15B:
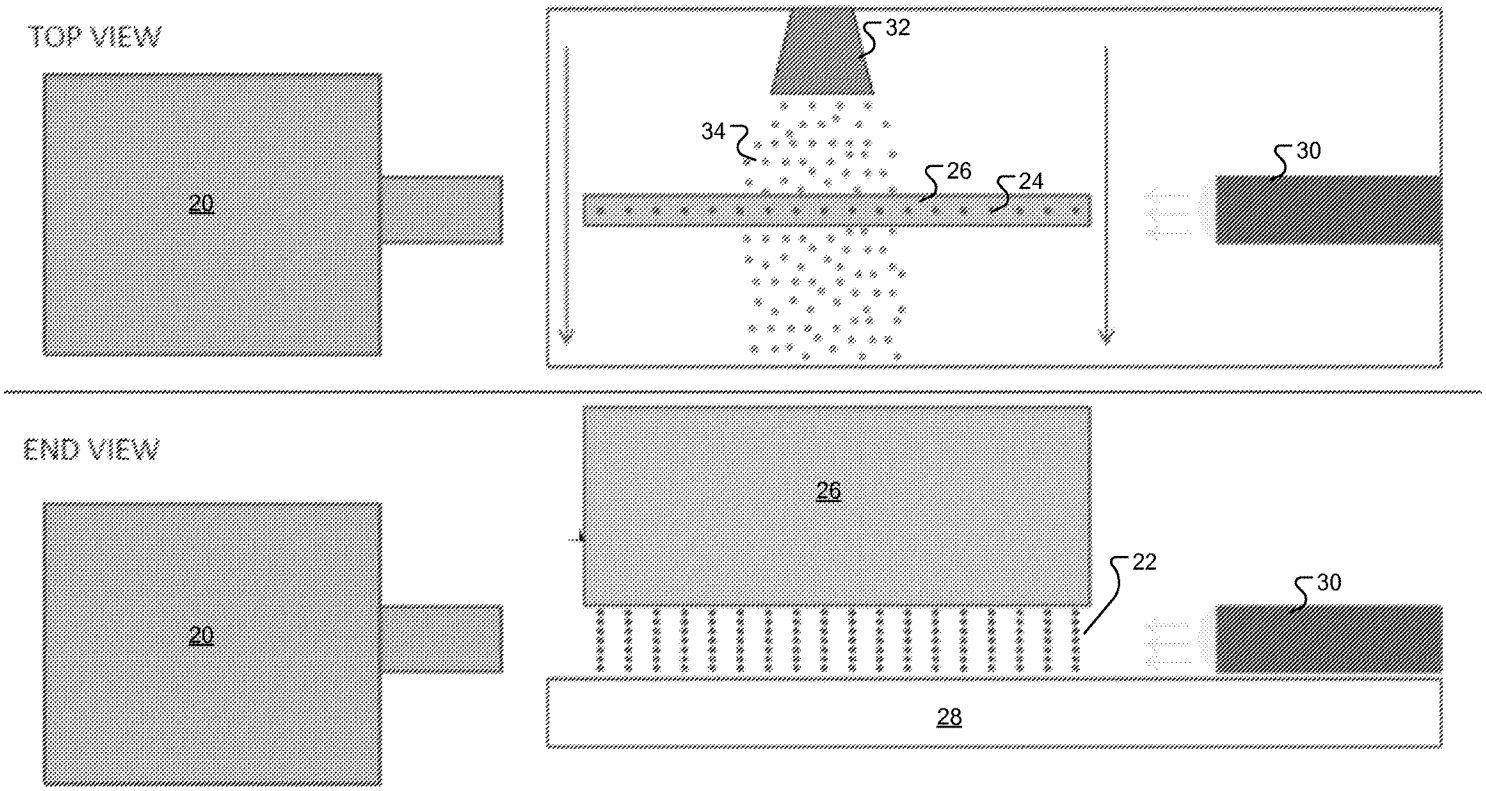
FIGS. 15A and 15B are diagrams of an experimental setup.

Referring to FIGS. 15A (top view) and 15B (end view), high speed video imaging was utilized to analyze the development of unsteady flows that can cause wood grain defects. A Photron (San Diego, Calif.) SA5 high speed camera 20 was used to image the positions of ink drops 22 ejected from nozzles 24 in a print head 26 as the ink drops 22 traveled to a substrate 28. The ink drops 22 were backlit by a light source 30 for imaging purposes. Flow visualization was achieved using a nebulizer 32 to seed the couette flow in the gap between the print head 26 and the substrate 28 with drops 34 of deionized water. The nozzles 24 were spaced at 100 dpi and printing was carried out at 7 m/s ejection velocity and 8 kHz. The standoff h between the print head 26 and the substrate 28 was 5 mm and the substrate was moved at a speed of 0.5 m/s. The positional data acquired during imaging was used to derive instantaneous drop velocity and acceleration during printing.

Figure 16:
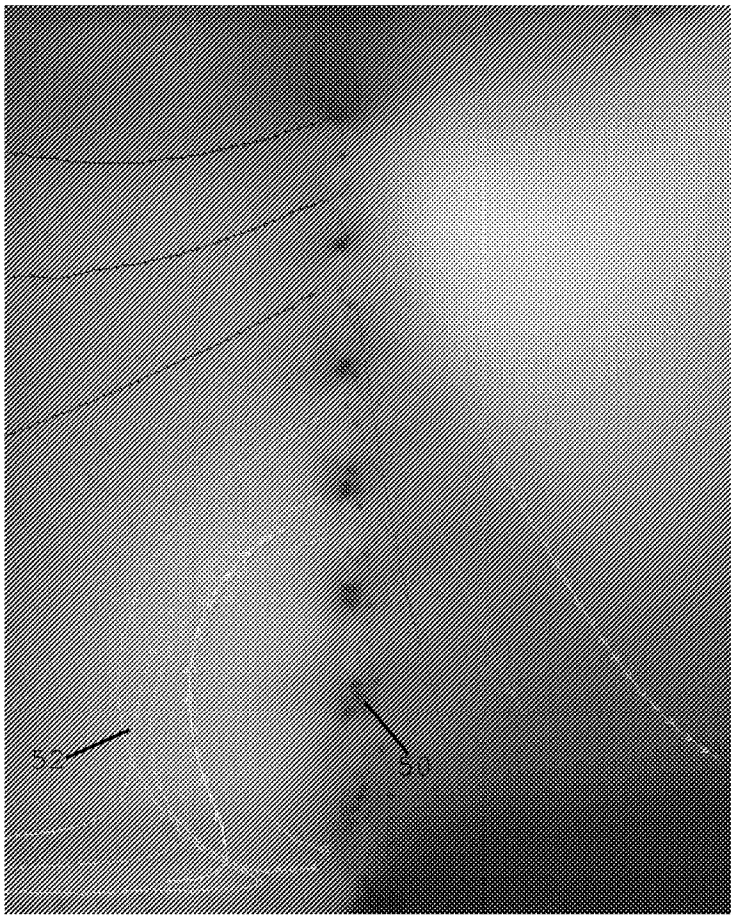
FIG. 16 is an image from a video of a printing process.

Referring to FIG. 16, an image from the high speed video shows a stream 50 of main drops and streamlines of a large eddy 52 developing upstream of the main drop stream 50. The image was obtained by seeding the flow under the print head with de-ionized water droplets. The lines in the image indicate contours of maximum velocity measured on each streamline path. The eddy causes high velocity gas flows to interact with the ink drops in the stream 50 for more than half the flight time between the print head 26 and the substrate 28, which can lead to significant drop placement errors. Without being bound by theory, it is believed that the eddy develops due to the interaction of the couette air flow entrained by substrate or print head motion and the air flow entrained by the droplet drag. As the droplet air flow impinges on the substrate, it changes direction to flow against the couette flow, thus causing formation of an eddy.

Figure 17:
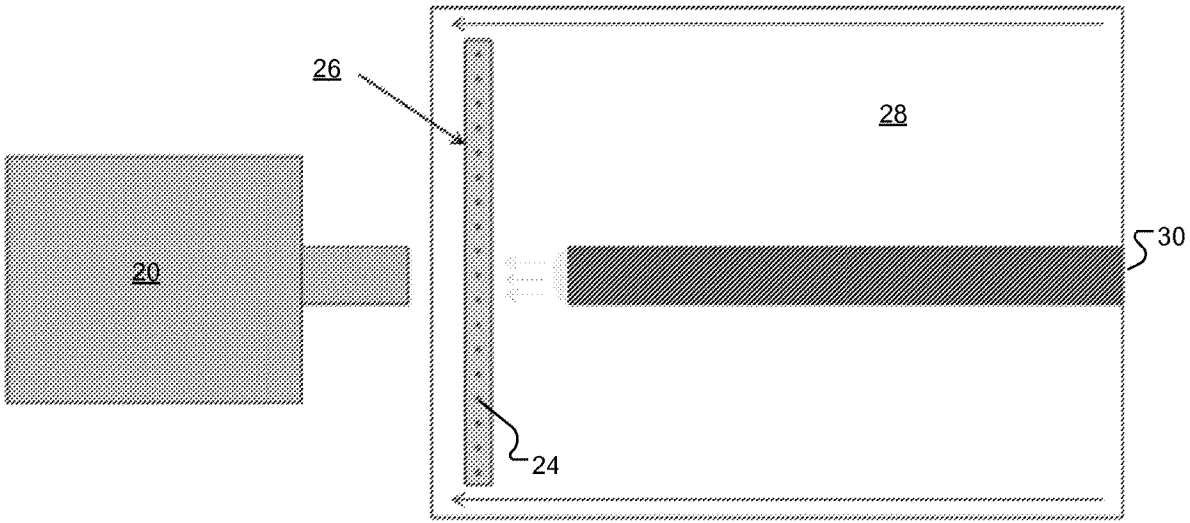
FIG. 17 is a diagram of an experimental setup.

Referring to FIG. 17, high speed video imaging was also used utilized to track the path of satellite drops during development of a wood grain defect on the substrate 28. The camera 20 was repositioned to a viewing angle normal to the print head 26 to capture the path of the ink drops during the flight between the print head 26 and the substrate 28. This camera configuration enables monitoring of the horizontal displacement of the native drops and satellite drops during printing, which can give insight into the in-flight development of wood grain defects.

Figure 18:
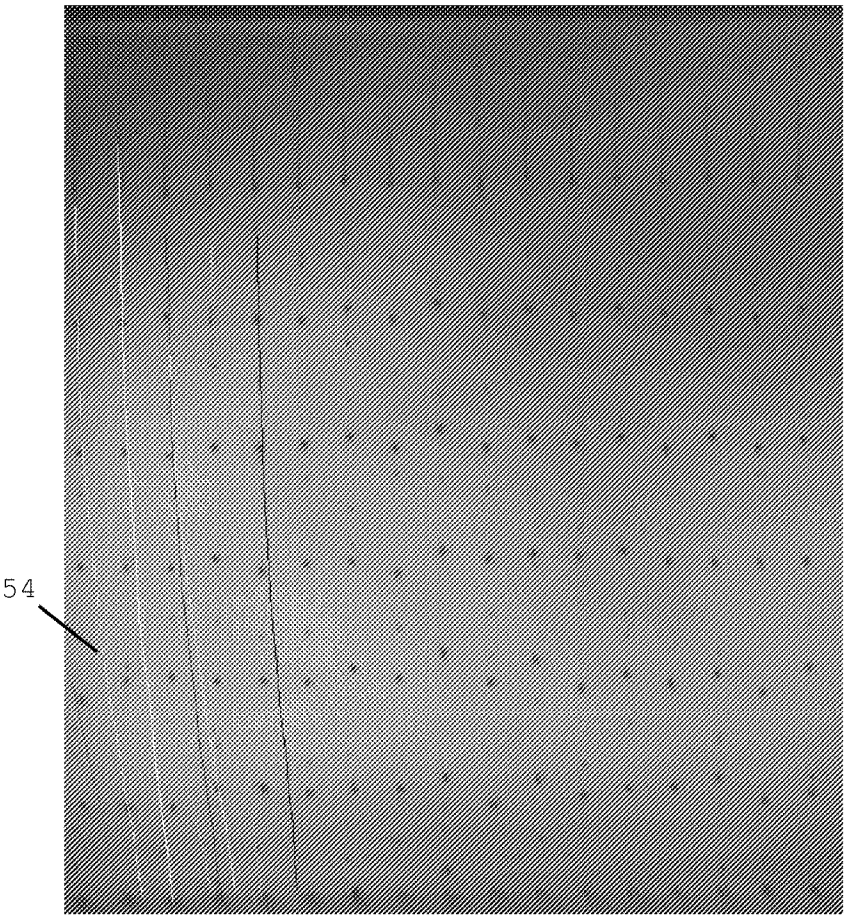
FIG. 18 is an image from a video of a printing process.

Referring to FIG. 18, an image from the high speed video shows that the satellite drops on the right side of the image are aligned with the native drops. The satellite drops on the left side of the image (indicated by the lines 54) are displaced from the native drops by a cross flow, causing the satellite drops to occupy an area intended to be non-printed. Subsequent frames of video show the satellite drop displacement moving from left to right across the image and periodically repeating with a repeat frequency of about 5-10 Hz. This periodic behavior can be correlated with the appearance of wood grain defects on the printed substrate.

Figure 19:
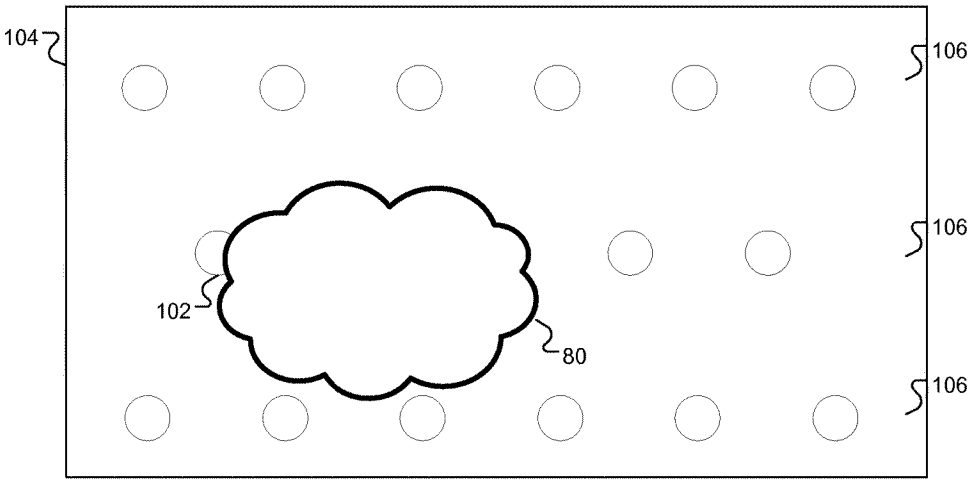
FIG. 19 is a diagram of nozzle plate wetting.

In some cases, when printing at high heights, the nozzle plate can be wetted by ejected ink, causing ink drops to be ejected from partially blocked nozzles with large trajectory errors or preventing one or more nozzles from ejecting ink drops altogether. Printing defects resulting from this partial or complete blockage of one or more nozzles on the nozzle plate by ejected ink are referred to as sustainability defects. Referring to FIG. 19, nozzle plate wetting occurs when there is an abundance of very small satellite drops with a mass less than about 0.5 ng. Very small satellites are generally more common for processes jetting main drops less than 10 ng, but can also occur when jetting larger drops with some inks or jetting processes. The very small satellite drops can be easily captured into the flow eddies under the print head and are deposited onto the nozzle plate 104. The deposited drops on the nozzle plate 104 can coalesce into one or more puddles 80 on the nozzle plate 104. The puddles 80 can partially or completely obscure one or more of the nozzles 102.

Figure 20B:
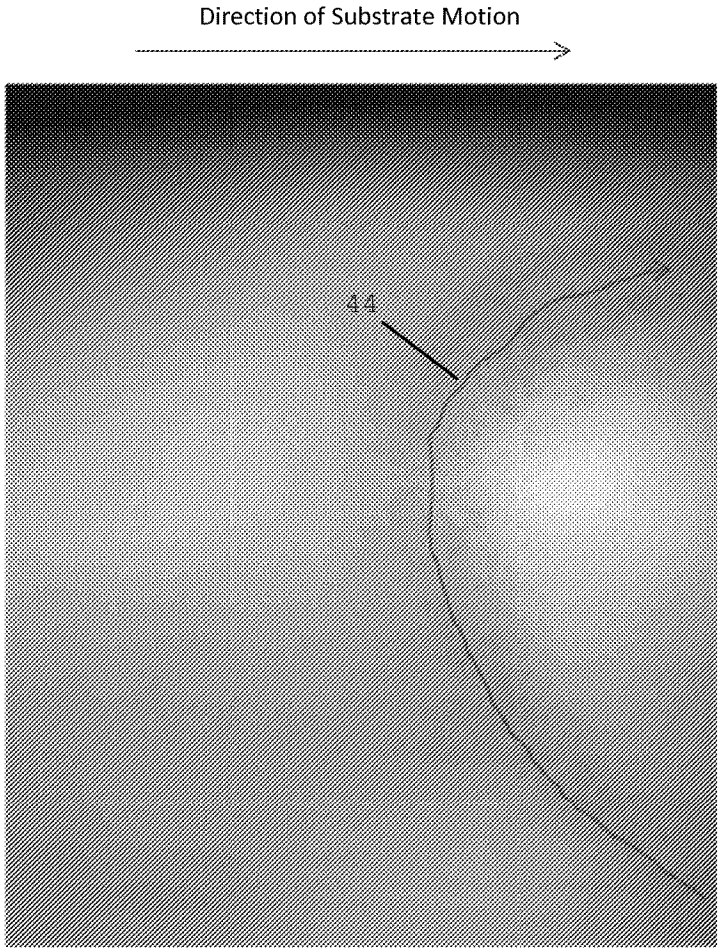
FIGS. 20A and 20B are images showing satellite drops under the print head.
Figure 20A:
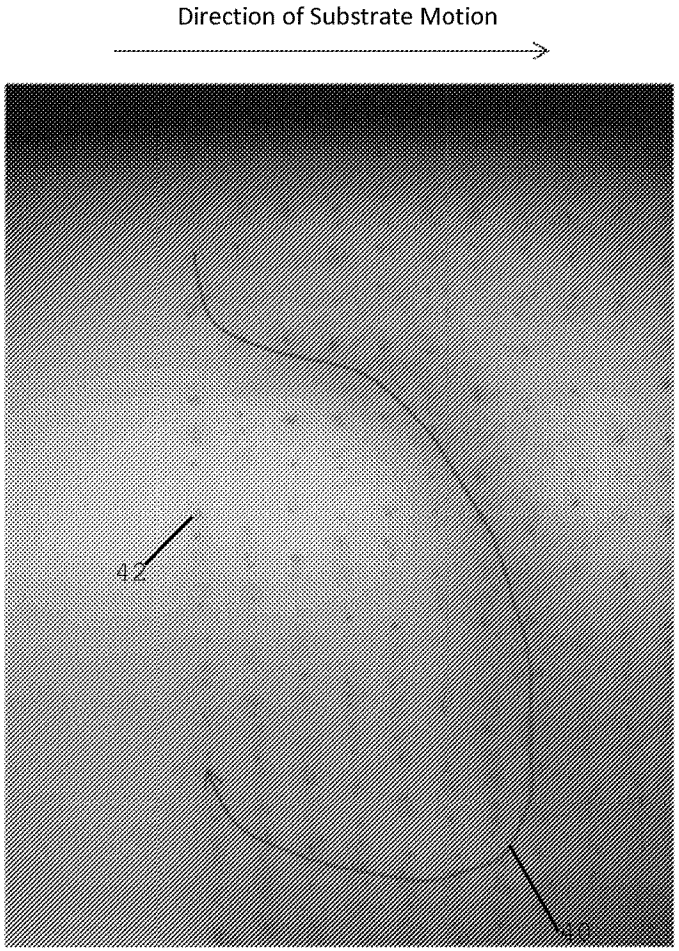

Without being bound by theory, nozzle plate wetting is believed to occur when small satellite drops rapidly lose velocity in the first portion of their flight path (e.g., in the first few millimeters), thus losing momentum. The low-momentum drops can be captured by eddies in the gap 112, which carry the drops back to the nozzle plate 104, where the drops are deposited. Referring to FIG. 20A, the development of an eddy 40 of satellite drops is shown amidst consecutive rows of main drops 42. In FIG. 20B, the nozzle jetting has stopped, allowing the eddy to carry the satellite drops up toward the nozzle plate (at the top of the image), as indicated by the arrow 44. The satellite drops are deposited onto the nozzle plate, where they can coalesce into puddles 80 that block one or more of the nozzles 102, thus degrading print quality and causing sustainability defects.

Figure 21:
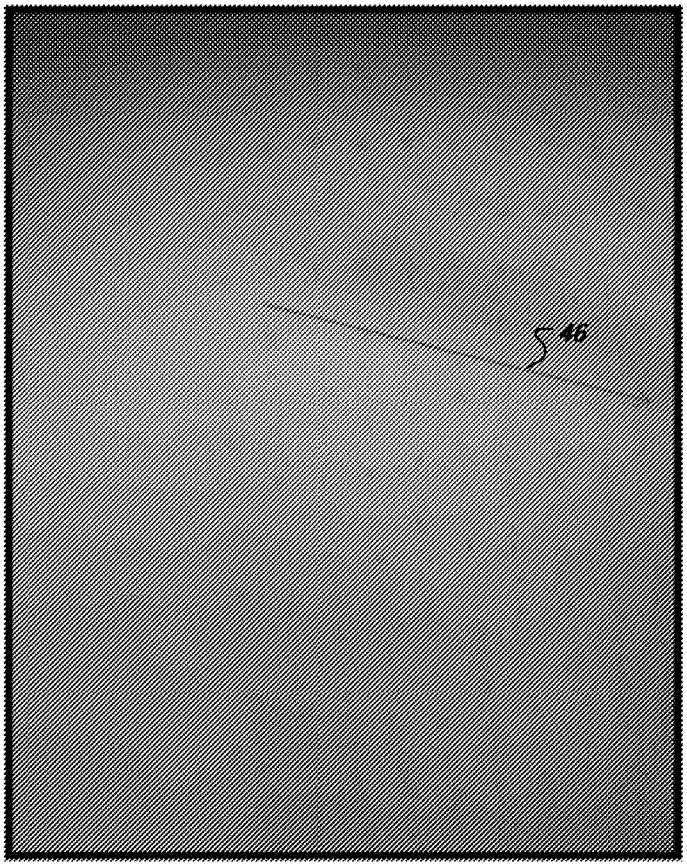
FIG. 21 is an image showing satellite drops under the print head when printing with forced air.

Gas flow through the gap 112, e.g., upstream forced gas provided by the forced gas module 500 (FIG. 5) or downstream suction provided by the downstream air flow module 800, can help mitigate these sustainability defects. Without being bound by theory, it is believed that gas flow through the gap 112 can stabilize unsteady air flows in the gap 112, as discussed above, thus helping prevent the formation of eddies that can carry small drops and satellite drops back to the nozzle plate. Furthermore, the small satellite drops have low momentum, and thus can be carried downstream by additional downstream flow, such as that provided by the forced gas or downstream suction. When these drops are carried downstream, less ink is deposited onto the nozzle plate and thus the sustainability of the print head can be improved. Referring to FIG. 21, in an example, when forced air is injected into the gap, no eddies are observed. Rather, a collection of satellite drops 46 is blown downstream by the forced air.

Figure 22:
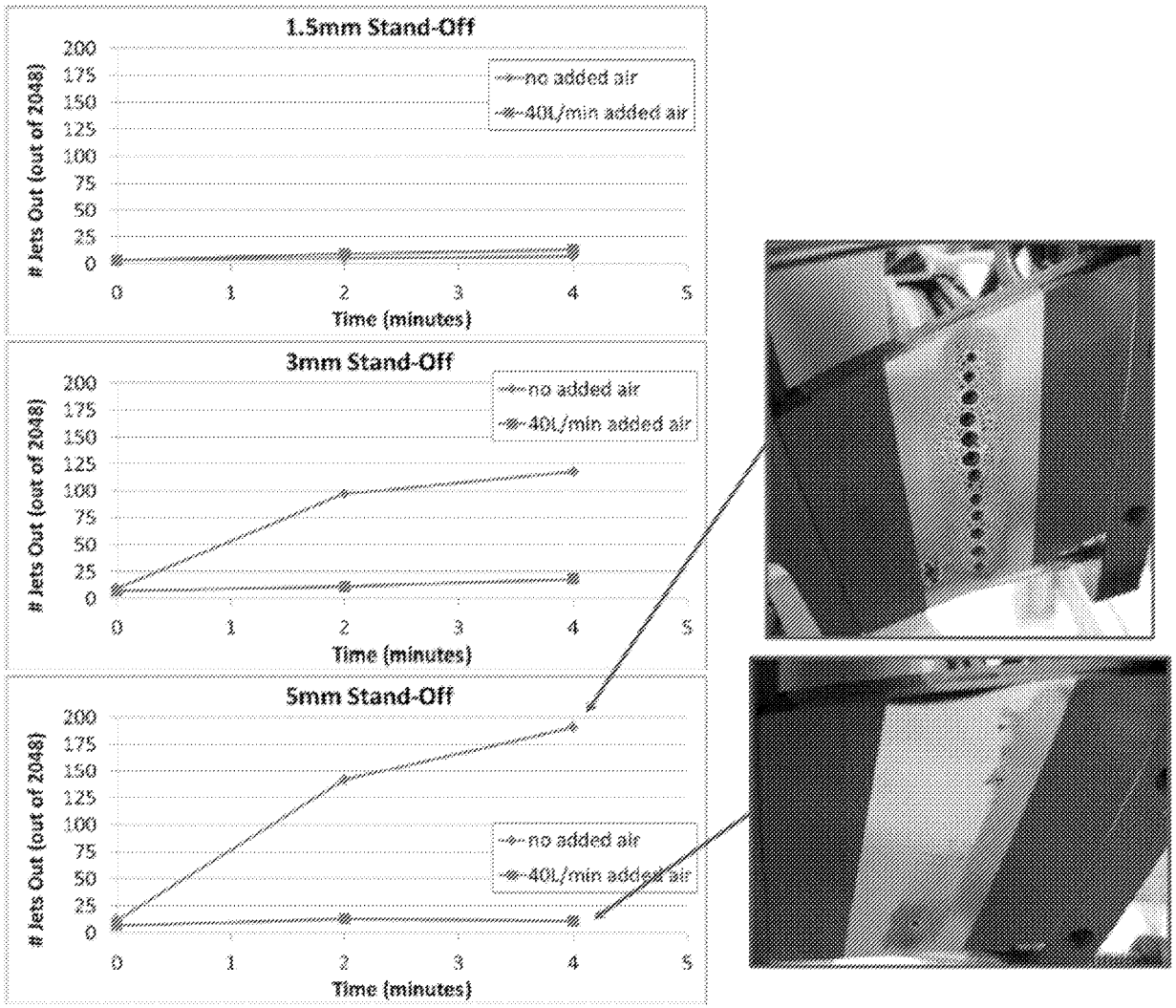
FIG. 22 is a plot of blocked nozzles as a function of time.

Referring to FIG. 22, the number of partially or completely blocked nozzles (out of a total of 2048 nozzles) is shown as a function of time for various standoff heights, with and without forced air. At high standoff heights (3 mm and 5 mm), significantly more nozzles are partially or completely blocked without forced air. In contrast, the use of 40 L/min of forced air reduces the number of blocked nozzles to a level comparable to that of the low standoff height (1.5 mm). Images of the nozzle plate after printing show significant puddling of ink on the nozzle plate following printing without forced air, while almost no ink is present on the nozzle plate following printing with forced air. These results indicate that forcing gas through the gap between the print head 100 and the nozzle plate 102 can help to mitigate sustainability defects, e.g., by reducing eddy formation and carrying satellite droplets downstream.

Figure 23:
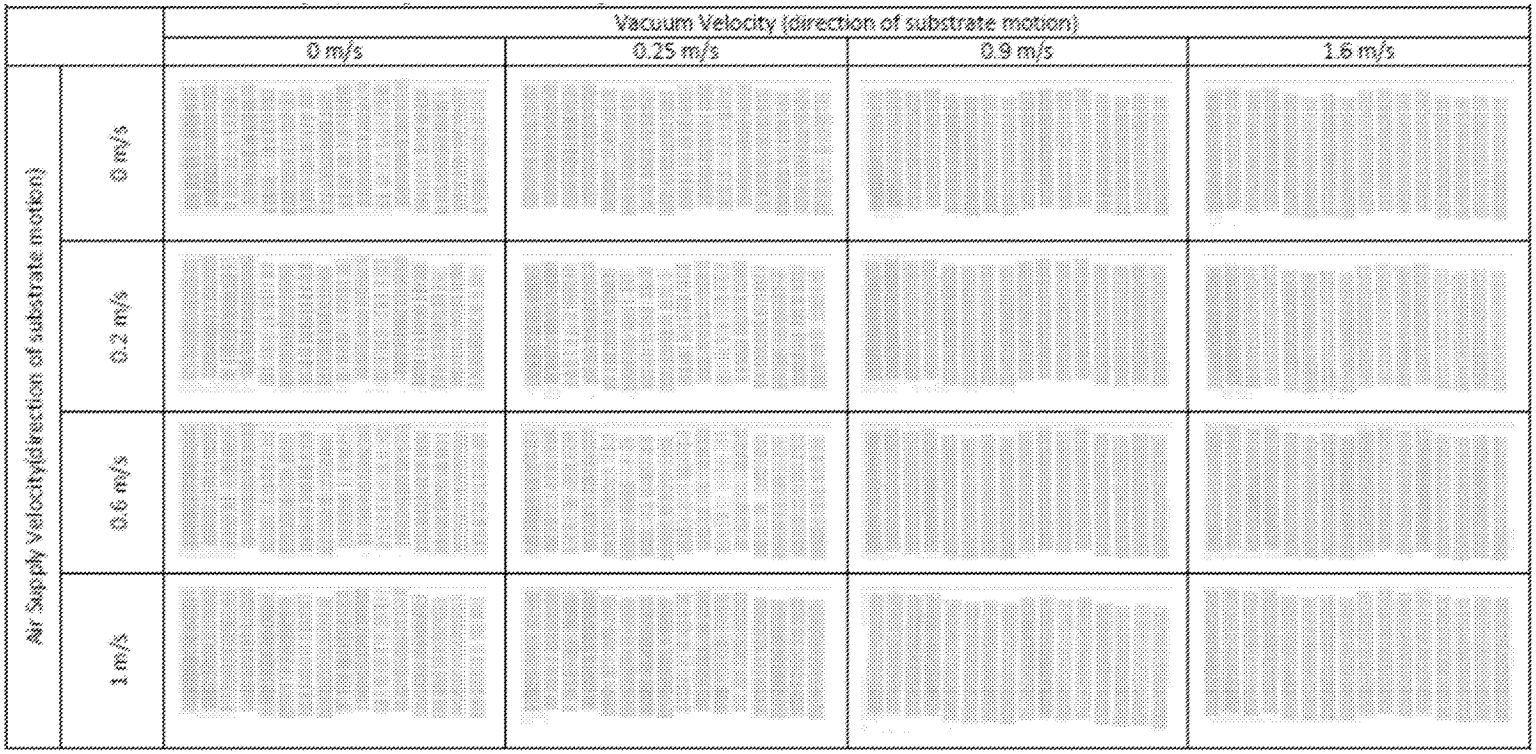
FIGS. 23-25 show results of a 4-minute sustainability test.
Figure 24:
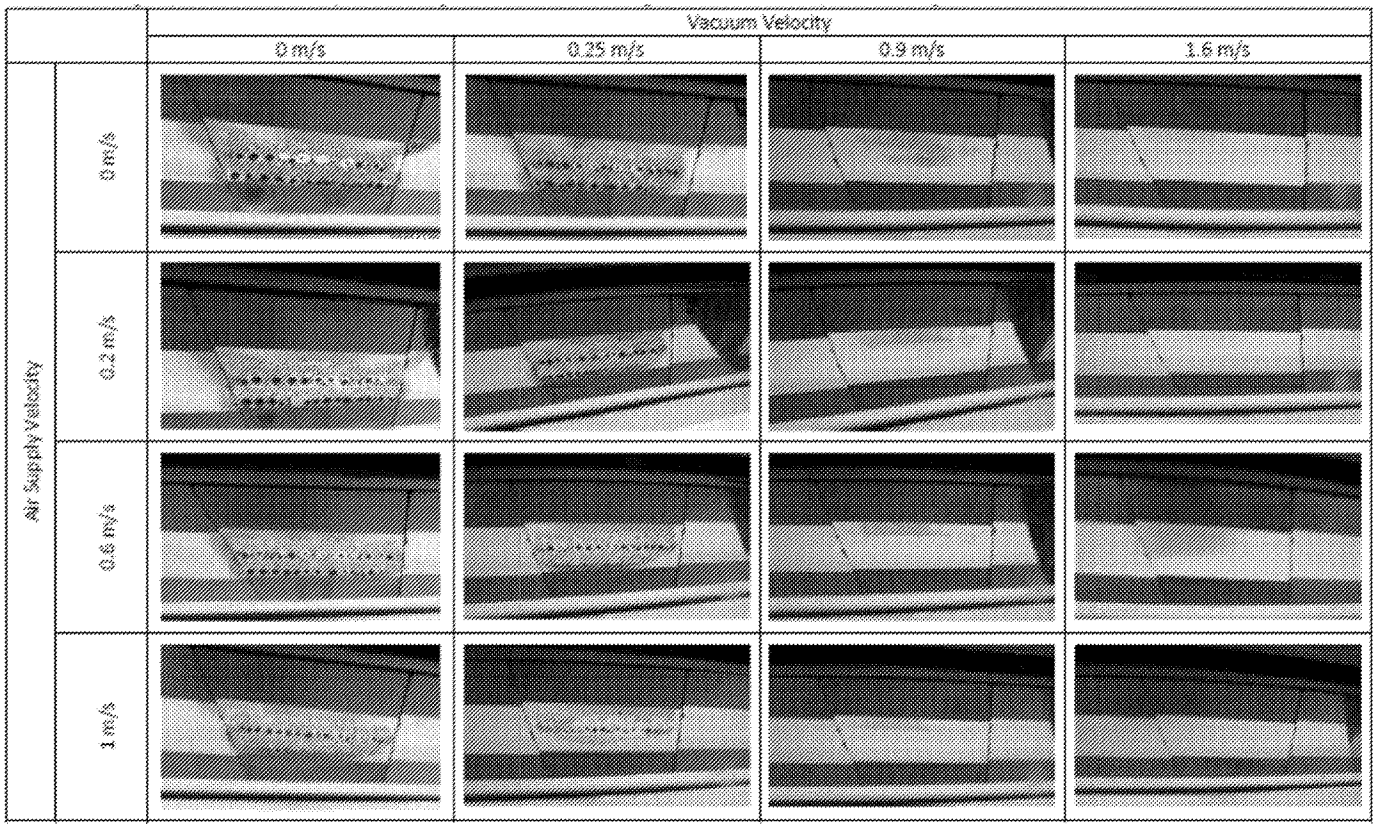
Figure 25:
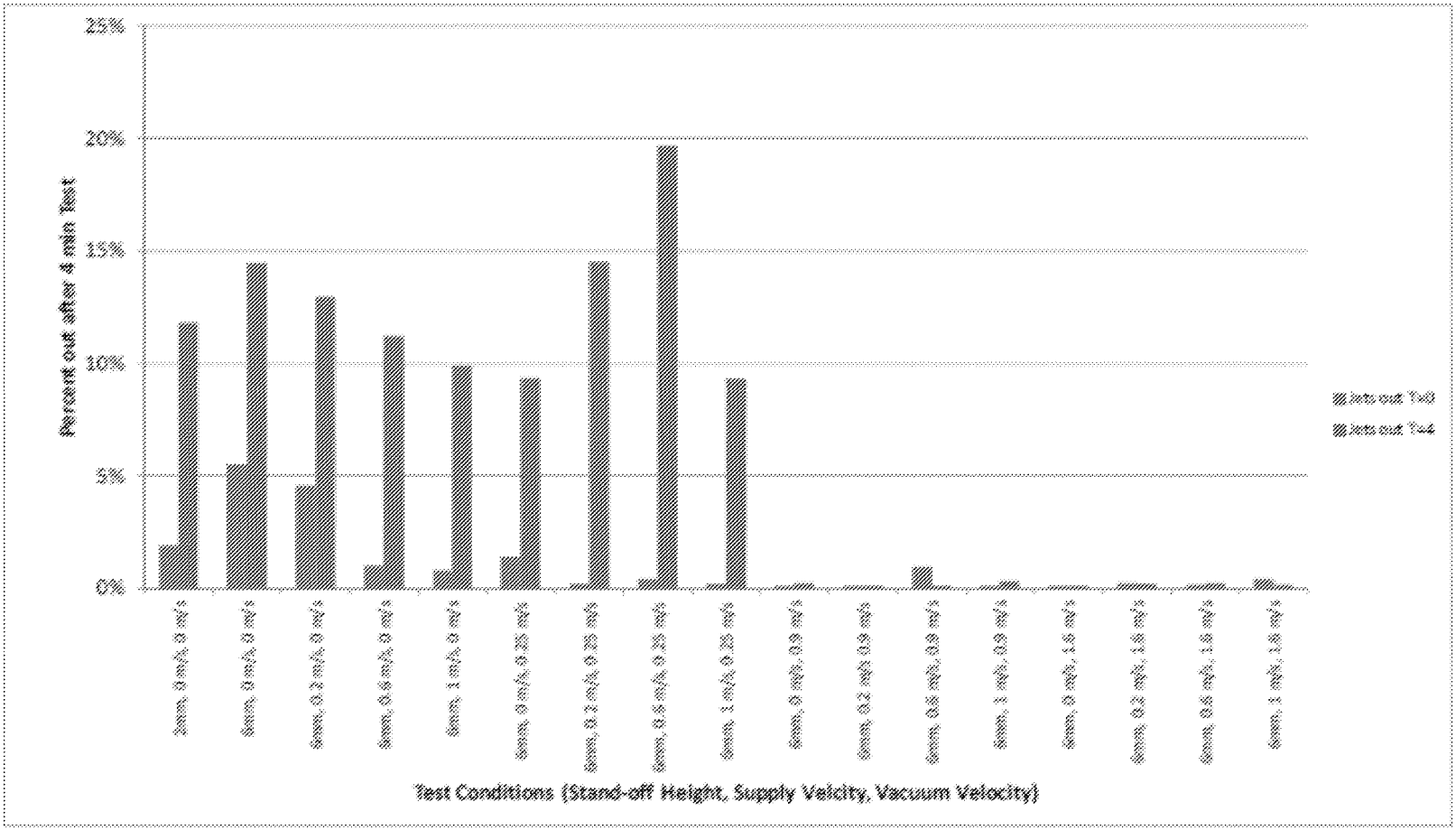

FIGS. 23-25 show the results of experiments carried out for various combinations of vacuum velocity (in the direction of substrate motion), e.g., as provided by a downstream air flow module 800, and air supply velocity (in the direction of substrate motion), e.g., as provided by a forced air module 500. These experiments show that air supplied upstream of a print head or vacuum supplied downstream of the print head can reduce printing defects, such as wetting defects that can occur due to the ejection of small satellite drops (e.g., <1 ng).

FIGS. 23-25 show results after 4 minute long sustainability tests at high jetting frequencies. These experiments were carried out using a printing system having a serpentine diffuser and an inlet plenum having the dimensions and orientation shown in FIG. 12B. The air supply and vacuum velocities are representative of the measured mid-gap velocities under the print head in non-printing conditions. Test parameters for these experiments were as follows:

Print head stand-off: 6 mm
Drop mass: 6.4 ng
Jetting frequency: 50 kHz
Printing duty cycle: 80%
Drop ejection velocity: 9 m/s
Substrate velocity: 1 m/s
Printing resolution: 1200×1200 dpi Referring to FIG. 23, a pattern of one line for each nozzle was printed to show all of the 2048 nozzles in the print head in a single image. Missing lines indicate that the nozzle is no longer printing after the 4 minute long test. Referring to FIG. 24, wetting of the nozzle plate is shown after the 4 minute test. Referring to FIG. 25, the percentage of jets out at the start (t=0 min) and end (t=4 minutes) of each test is shown. The print quality, nozzle wetting, and percentages of jets out improve as the air flow velocity increases, and the vacuum is shown to be more effective at preventing jets out.

In some cases, drag on ink drops when printing at high height can affect the transient response of the ink jet printing system when jetting ink drops into a still flow field, e.g., when printing is starting up. A slipstream is a gas flow pattern in the gap that is established by constant, steady jetting of streams of drops by the nozzles in the print head. Before the slipstream is developed, an initial drag force is exerted on the first few ink drops when printing is initiated (e.g., the first 10-20 ink drops) that leads to a reduction in velocity of those initial drops, making the initial drops subject to displacement errors. After the slipstream is fully developed, the drag force on the ejected drops is reduced and stabilized, and subsequent drops travel at a substantially consistent velocity. We sometimes refer to the initial printing period before the slipstream develops as the startup period.

Figure 26:
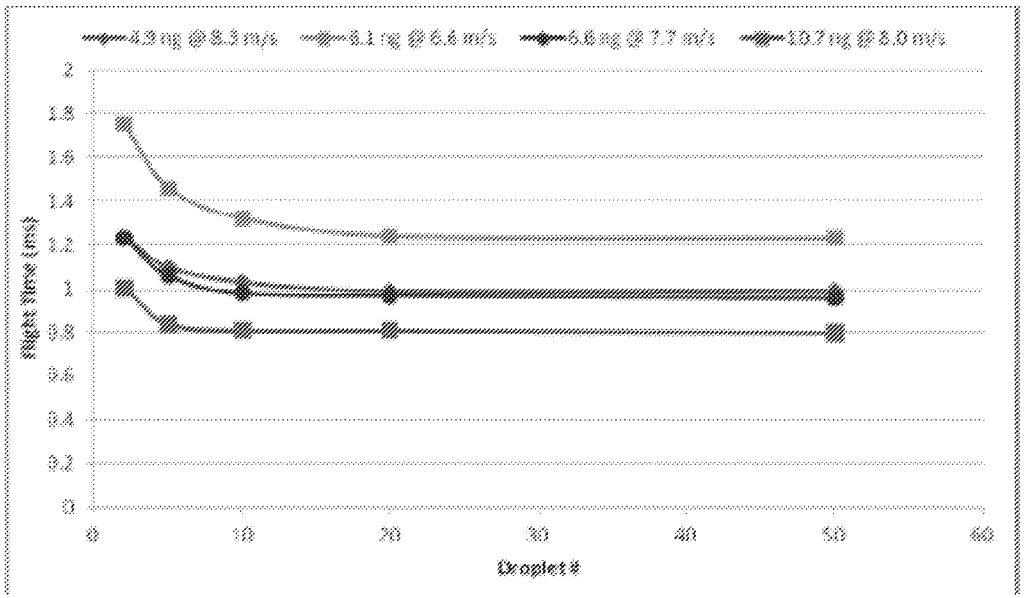
FIG. 26 is a plot of flight times.

FIG. 26 shows experimental flight times across a 5 mm gap for the first 50 drops ejected from a nozzle for various combinations of drop mass and ejection velocity. The data were obtained using a high speed camera, e.g., in the configuration shown in FIG. 17, and printing was performed using a SAMBA 3 pl print head at 10 kHz. A steady state velocity was reached after about 20 drops were ejected from the nozzle. Drops ejected at a slower initial velocity of 6.6 m/s took longer to reach steady state due to their low final velocity at the substrate (2.5 m/s). Conversely, drops ejected with larger mass (10.7 ng) were observed to reach steady state faster due to the smaller decrease in velocity during flight. Additional experiments (not shown) conducted at 20 kHz and 40 kHz yielded similar results.

The drag experienced by the initial drops, before the slipstream is established, can be reduced by printing in a low density environment, e.g., in a helium environment. For instance, by injecting helium into the gap, e.g., using the forced gas module 500 (FIG. 5), the drag on the initial drops can be reduced, thus reducing the time to reach a steady state drop velocity.

Figure 27:
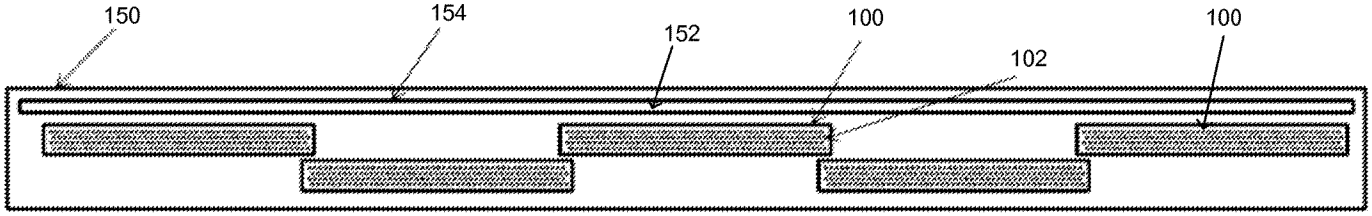
FIG. 27 is a diagram of a print bar assembly.

Referring to FIG. 27, in some embodiments, a print bar assembly 150 receives multiple print heads 100, e.g., to enable printing on a substrate over a large area. A single forced gas module 152 injects a gas, such as air, helium, or another gas, to flow through the gap between each print head 100 and the substrate, thus helping to stabilize unsteady air flows that may occur under one or more of the print heads 100. The forced gas module 152 can include a gas supply port that supplies gas to a manifold that distributes the gas to one or more gas nozzles 154, which inject the gas into the gap below each print head. In some examples, the gas nozzle is a single, elongated slot (e.g., as shown in FIG. 27). In some examples, the gas nozzle is implemented as a filter screen or mesh matrix formed of one or more rows of small holes that can collectively provide air flow into the gaps.

In some examples, the forced gas module 152 can be formed integrally with the print bar assembly 150, for instance, by a stamping process, a three dimensional printing process, an injection molding process, or another fabrication process. In some examples, the forced gas module 152 can be a separate unit that can be positioned adjacent to the print bar assembly 150 or connected to the print bar assembly 150 during printing.

Figure 28:
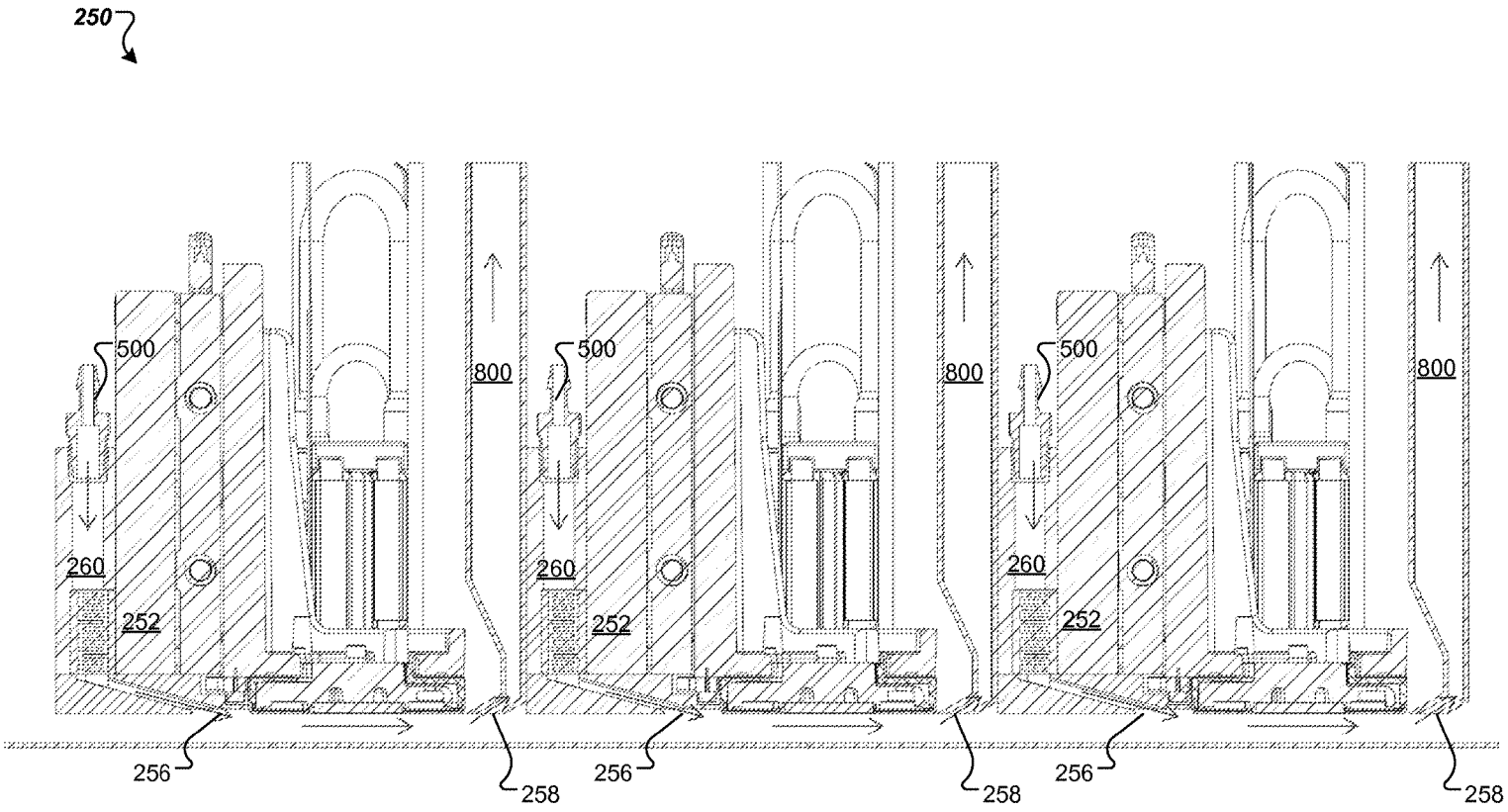
FIG. 28 is a diagram of an ink jet printing system.

Referring to FIG. 28, in some embodiments, multicolor printing can be achieved using a printing assembly 250 that includes multiple print bars 252, each print bar 252 capable of printing a different color ink onto the substrate 110. For instance, each print bar 252 can be about 5-20 cm in width, e.g., about 5-6 cm in width. Each print bar 252 is provided with a dedicated air flow system that can provide an upstream air flow 256 from a corresponding forced air module 500, a downstream suction or vacuum 258 from a corresponding downstream air flow module 800. In some examples, the space between adjacent print bars 252 is narrow, e.g., about 50-200 mm. For instance, the space between adjacent print bars 252 can be made as small as possible in order to reduce the sensitivity of the printing assembly to other errors, such as alignment errors. To be compatible with this narrow spacing, the air flow system for each print bar 252 can have small dimensions, such as dimensions that enable components of the air flow system, such as gas nozzles (e.g., gas nozzles 508), slots 252, or suction nozzles (e.g., suction nozzles 802) or both, to fit in the space between adjacent print bars 252. In some examples, non-functional print heads can be provided at one or both ends of the printing assembly 250 to prevent adverse air flow effects.

Figure 29:
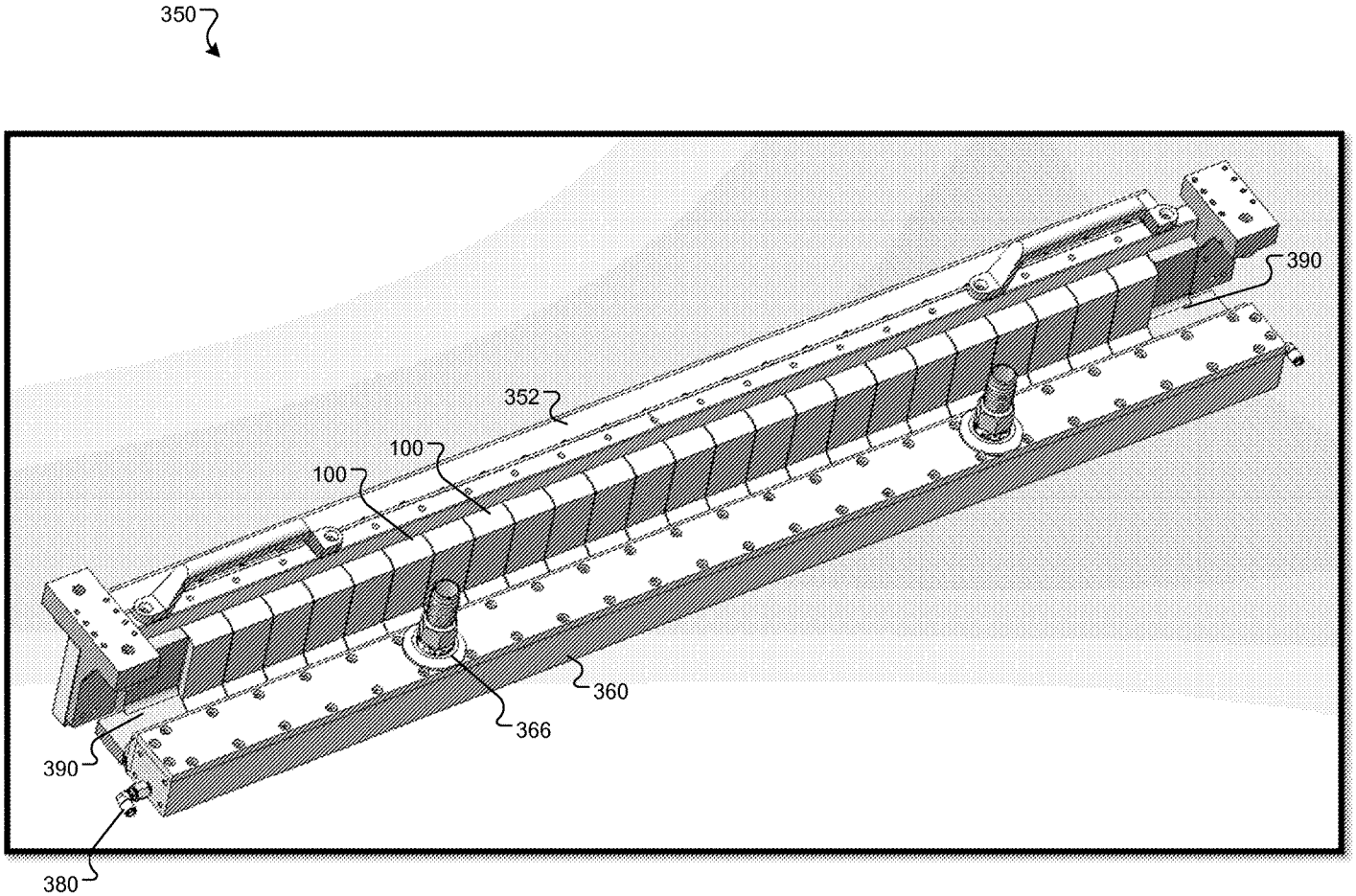
FIGS. 29 and 30 are diagrams of an ink jet printing system with a suction module.

Referring to FIG. 29, in some examples, a printing assembly 350 includes a print bar 352 having multiple print heads 100. The printing assembly 350 also includes a single downstream air flow module 360 (sometimes also referred to as a suction module) that applies a suction to the gap between each print head 100 and the substrate (not shown), thus helping to stabilize unsteady air flows that may occur under one or more of the print heads 100. In some examples, to prevent the air flow under one print head 100 from affecting the air flow under a neighboring print head 100, the print heads are separated along the process direction by a distance of, e.g., at least about 10 mm, at least about 15 mm, at least about 20 mm, about 20 mm, or another distance.

Figure 30:
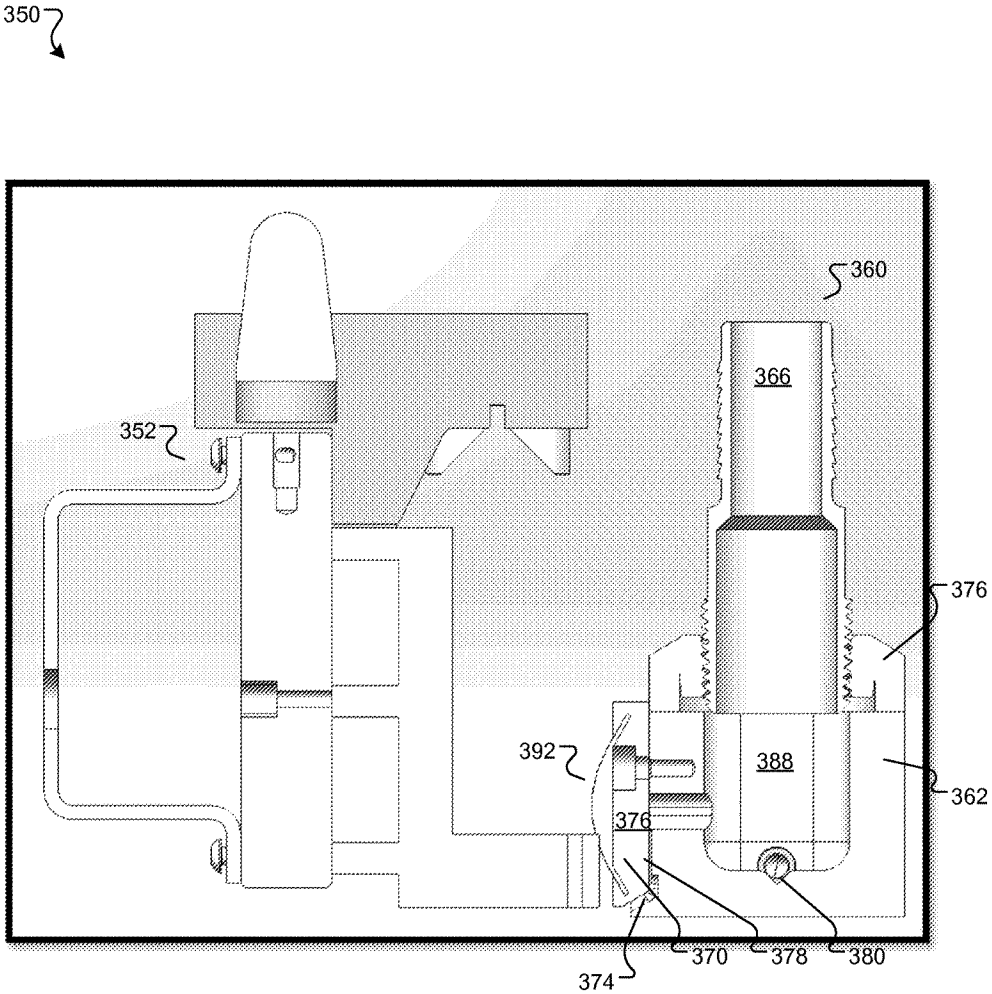

Referring also to FIG. 30, the suction module 360 can include a vacuum manifold 362 connected to a suction source (not shown) through one or more outlet ports 366. In an example, the suction module 360 can include two outlet ports 366 each with a 25 mm inner diameter. A flow path through the vacuum manifold 362 can include a flow chamber 368 connected to the gap under each print head 100 via a flow inlet 370. The flow path can include components that control, modify, or shape the air flow along the flow path, such as a flow equalizer 372, an inlet plenum 374, or other features. The suction module 360 can be completely or partially enclosed by a cover plate 376 and the flow inlet 370 can be completely or partially enclosed by an inlet cover plate 378. The suction module 360 can include one or more ink drain ports 380 to allow excess ink to be removed from the suction module 360.

In some examples, the suction module 360 can be configured such that the flow resistance of air flowing under the vacuum manifold 362 is greater than the flow resistance through the gap between each print head 100 and the substrate. This configuration helps to ensure that a large percentage of the air flow into the vacuum manifold 362 is pulled from the upstream direct (e.g., from under the print heads 100). In some instances, a high flow resistance under the vacuum manifold 362 can be achieved by positioning the suction module such that the air flow path under the vacuum manifold 362 is at a lower height than the gap under the print heads 100. For instance, the air flow path under the vacuum manifold 362 can be between about 1 mm and about 5 mm lower than the position of the gap under the print heads 100, e.g., about 2 mm lower. In some instances, a high flow resistance under the vacuum manifold 362 can be achieved by increasing the width of the vacuum manifold 362, e.g., such that the vacuum manifold 362 is wider than the width of the print heads 100. For instance, the vacuum manifold 362 can be between about 10 mm wide and about 100 mm wide, e.g., about 60 mm wide (for a print head having a width of between about 6 mm and about 60 mm). In some instances, a high flow resistance under the vacuum manifold 362 can be achieved by including one or more components in the air flow path that can reduce the downstream air flow, e.g., a brush, an air knife, or another component.

In some examples, the printing assembly 350 can include both the suction module 360 and an upstream forced gas module. The presence of upstream forced gas in the gap can reduce fluid resistance in the gap, thus allowing the printing system 350 to be implemented with a narrower vacuum manifold 362.

Referring to Table 1, results of computational fluid dynamics (CFD) simulations of the printing assembly 350 demonstrate the role of recessing the air flow path under the vacuum manifold 362 relative to the gap below the print heads 100 and the role of the width of the vacuum manifold 362. By "flush," we mean that the vacuum manifold and print heads are approximately at the same distance from the substrate. These CFD results show that recessing the air flow path under the vacuum manifold 362 and increasing the width of the vacuum manifold 362 can affect the percentage of air flow that is pulled from under the print heads into the suction module 360.

Referring still to FIG. 29, in some examples, the printing assembly 350 extends beyond the print heads 100 to include a non-printing section 390 on each end of the print bar 350. The non-printing section 390 can be, e.g., about 150 mm long on each end. The presence of the non-printing sections 390 can help to minimize end flow effects that can adversely affect the flow patterns in the gap under the print heads 100. When the printing assembly 350 is implemented with both the suction module 360 and an upstream forced gas module, the reduced fluid resistance in the gap can allow the length of the non-printing regions to be reduced.

TABLE 1

Effect of suction module geometry on flow under print heads.

| Manifold Width | Manifold Position | % Flow Under Print Heads |
|---|---|---|
| 13 mm | Flush | 35% |
| 13 mm | 3 mm wide baffle protruding 2 mm below the vacuum manifold | 64% |
| 60 mm | Flush | 53% |
| 60 mm | 1 mm lower (4 mm gap) | 61% |
| 60 mm | 2 mm lower (3 mm gap) | 70% |
| 60 mm | 3 mm lower (2 mm gap) | 79% |
| 60 mm | 4 mm lower (1 mm gap) | 89% |

Referring to FIG. 30, in some examples, the printing assembly 350 can include a seal 392 that seals the gap between the print heads 100 and the substrate along the length of the printing assembly 350, except for the connection between the gap and the flow inlet 370. The presence of the seal 392 can help to minimize end flow effects that can adversely affect the flow patterns in the gap under the print heads 100.

Figure 31:
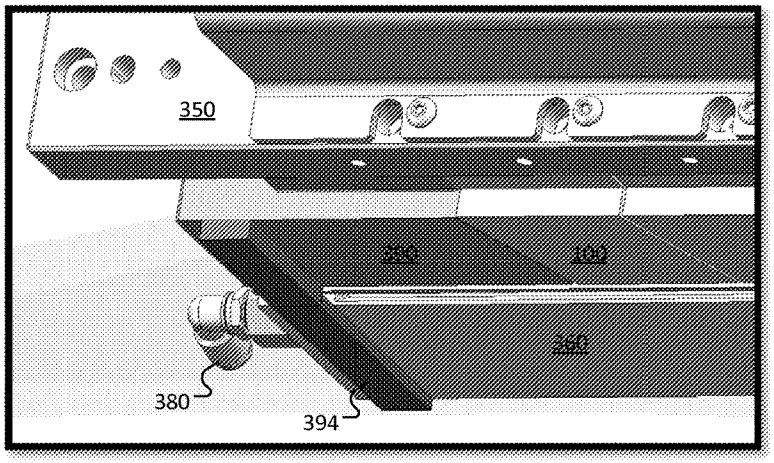
FIG. 31 is a diagram of a portion of a print bar.

Referring to FIG. 31, in some examples, the printing assembly 350 can include a seal 394 that prevents air flow out of the ends of the print bar. The seal 394 enables the length of the non-printing sections 390 to be reduced by maintaining the uniformity of the air velocity of vectors close to the end of the print bar.

Figure 32:
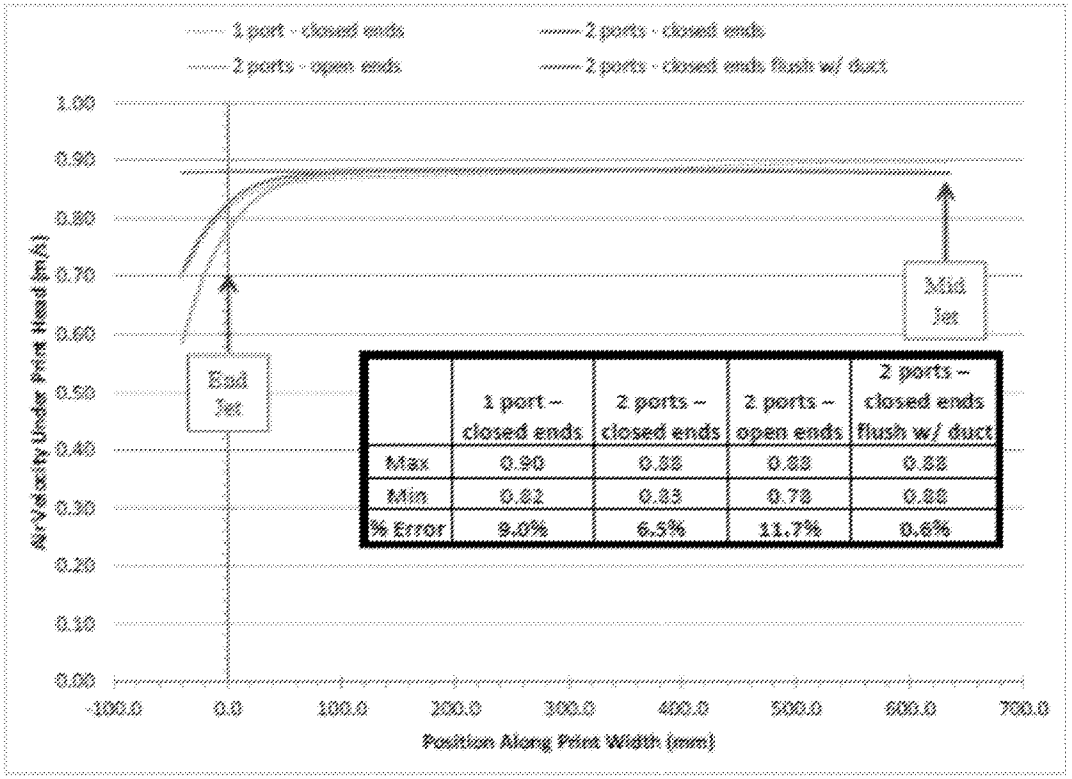
FIG. 32 is a plot of the effect of sealing a gap under a print bar on the air flow profile under the print bar.

Referring to FIG. 32, results of a CFD simulation show the effects of sealing the gap below the print heads 100 on the flow profile in the gap below the print heads both at the end of the print bar and towards the center of the print bar.

Figure 33:
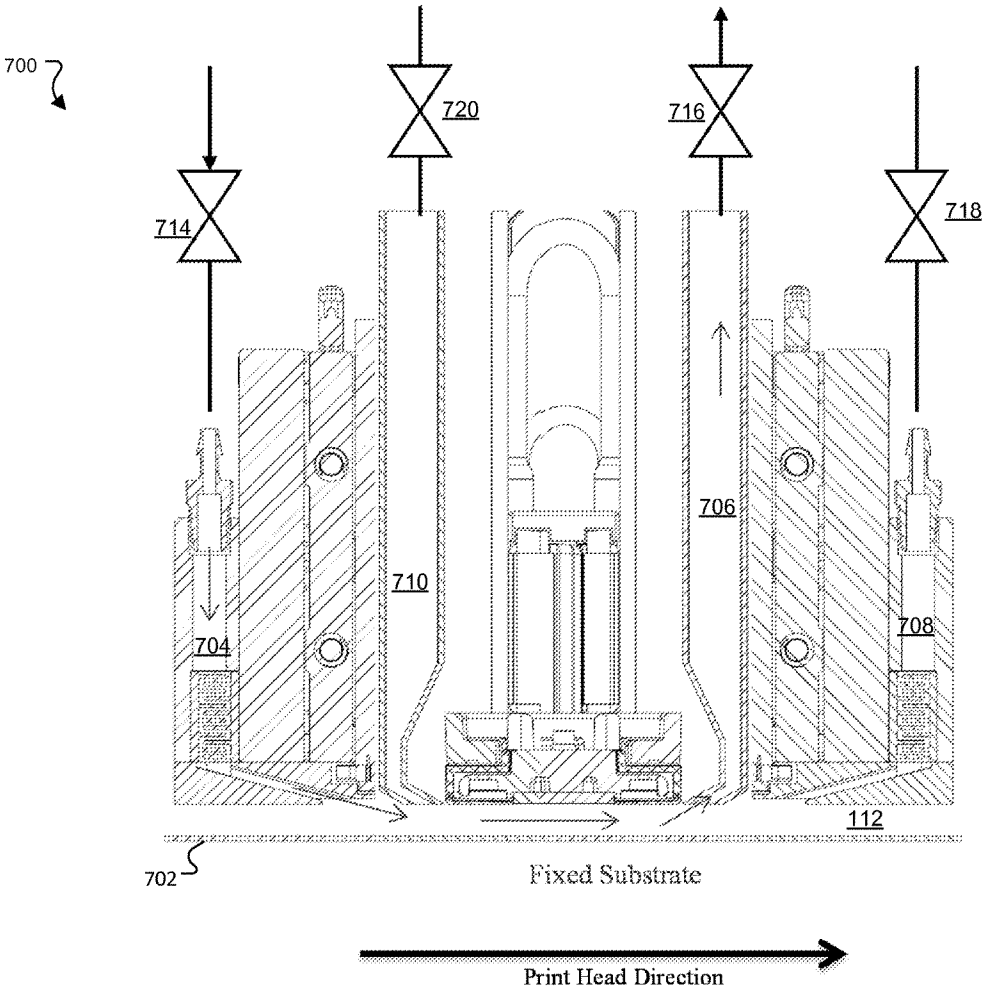
FIG. 33 is a diagram of an ink jet printing system

Referring to FIG. 33, in some embodiments, a scanning print assembly 700 is configured for printing onto a fixed substrate 702. The scanning print assembly 700 includes one or more print heads and can print onto the fixed substrate 702 by moving back and forth (sometimes referred to as scanning). When the scanning print assembly 700 scans in a first direction (e.g., when the printing assembly scans to the right as shown in FIG. 33), air flow in the gap 112 is provided by a first forced gas module 704 positioned upstream of the gap 112 relative to the first direction and by a first suction module 706 positioned downstream of the gap 112. When the scanning print assembly 700 reverses direction (e.g., when the printing assembly scans to the left), air flow in the gap 112 is provided by a second forced gas module 708 positioned upstream of the gap 112 relative to the second direction and by a second suction module 710 positioned downstream of the gap 112.

In order to allow steady state air flow to be achieved quickly when the printing direction is changed, a set of valves, such as solenoid valves, are coupled to the gas and suction modules. When the scanning print assembly 700 switches from scanning to the right to scanning to the left, the first forced gas module 704 is disabled by closing a valve 714 and the first suction module 706 is disabled by closing a valve 716; and the second forced gas module 708 is enabled by opening a valve 718 and the second suction module 710 is enabled by opening a valve 720. To switch direction from scanning to the right to scanning to the left, the opposite occurs. This valve-controlled switching helps the air flow pattern in the gap 112 to quickly reach steady state, thus allowing the scanning direction of the print assembly 700 to be changed quickly.

In the example of FIG. 33, both forced air and suction are applied to the gap 112. The presence of both forced air and suction can help to overcome the high fluid resistance under the print head that is due to the presence of two vacuum manifolds and two nozzles. In some examples, only forced air or only suction can be applied to the gap 112.

Figure 34A:
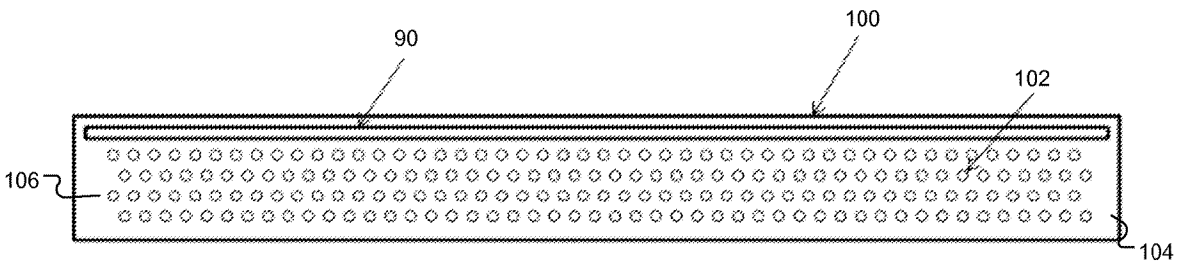
FIGS. 34A and 34B are top and side views, respectively, of a print head with a laminar flow slot
Figure 34B:
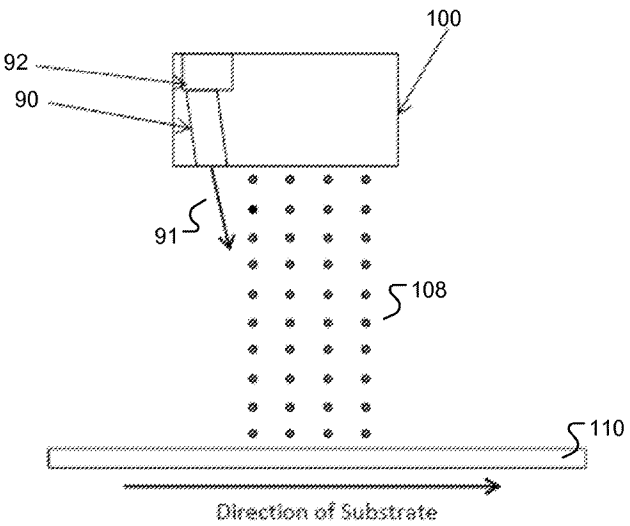

Referring to FIGS. 34A and 34B, in some embodiments, a laminar flow of air or low density gas can be established in the direction of jetting to provide a consistent flow in the direction of droplet motion. For instance, a laminar flow slot 90, implemented as an elongated hole, can be provided adjacent to one or more rows 106 of nozzles 102 in the nozzle plate 104. Each laminar flow slot 90 can provide a low velocity, laminar flow of air 91 in the direction of jetting motion, thus reducing drag on initially printed drops and reducing the time to reach a steady state drop velocity. For instance, the laminar flow slots 90 can be supplied by a gas supply port 92 that is connected to a gas source, such as the environment or a gas supply such as a canister of compressed air or helium. The laminar flow slots 90 can extend beyond the nozzles 102 at the end of each row 106, e.g., by a distance of about 2-10 mm.

Figure 35A:
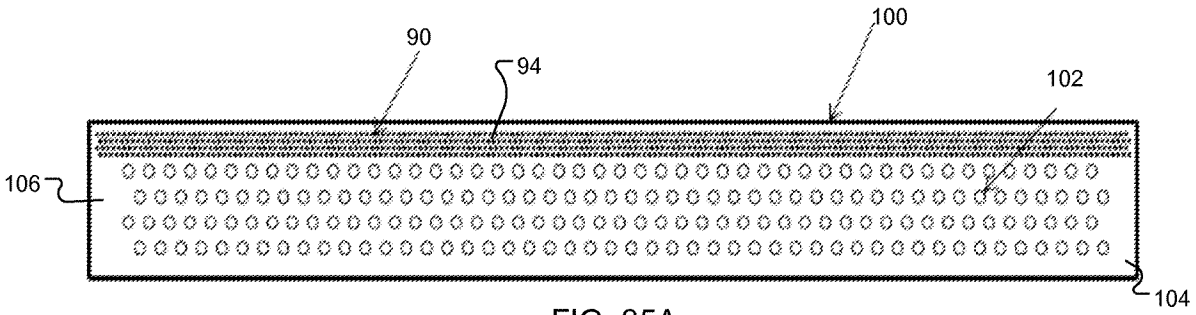
FIGS. 35A and 35B are top and side views, respectively, of a print head with a laminar flow slot.
Figure 35B:
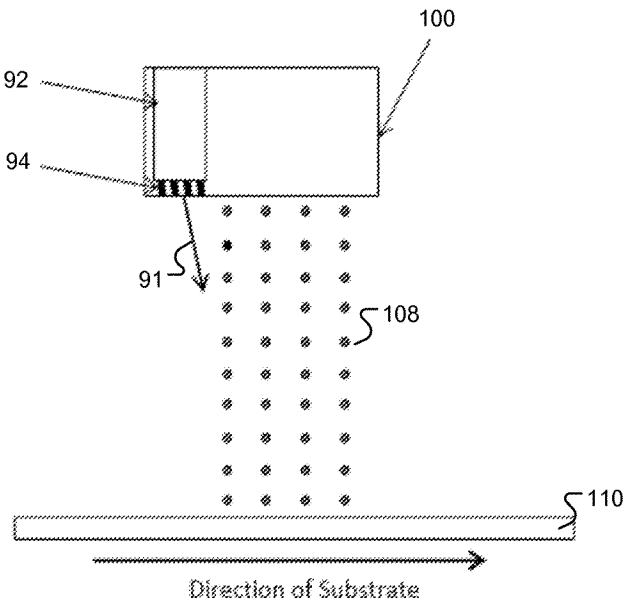

Referring to FIGS. 35A and 35B, in some examples, each laminar flow slot 90 can be implemented as a filter screen or mesh matrix formed of one or more rows of small holes 94 that can collectively provide a laminar flow of air substantially in the direction of jetting motion.

Figure 36:
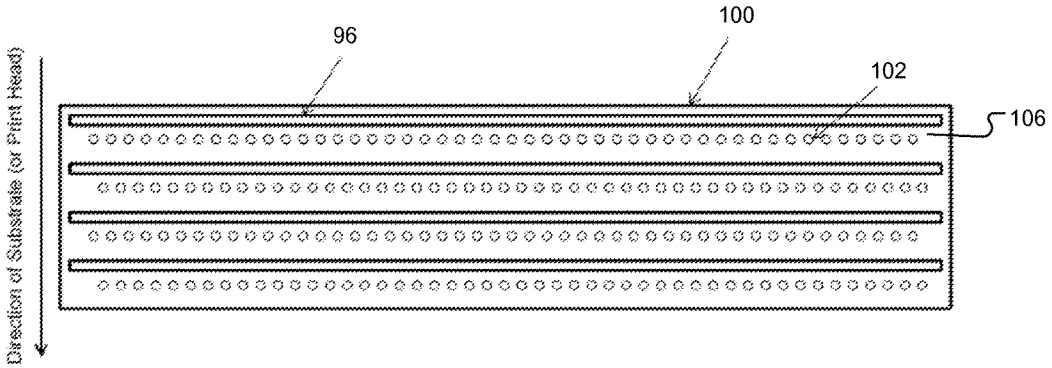
FIG. 36 is a top view of a print head with multiple laminar flow slots.

In some examples, e.g., as shown in FIGS. 34A and 34B, a single laminar flow slot 90 is provided for multiple rows 106 of nozzles, e.g., for up to 20 rows of nozzles. In some examples, e.g., as shown in FIG. 36, a laminar flow slot 96 is provided for each row 106 of nozzles, e.g., upstream of each row of nozzles. For instance, the laminar flow slots 96 can be interleaved among the rows 106 of nozzles such that each laminar flow slot 96 is upstream of a corresponding row 106 of nozzles.

The laminar flow slots 90, 96 can be disposed close enough to the rows 106 of nozzles 102 to establish a flow field along the flight path of the ink drops, e.g., within about 1 mm of the nozzles 102. Air or low density gas can be provided through the laminar flow slots 90, 96 at a sufficient velocity to increase the velocity in the area where jetting occurs without inducing the development of unsteady flows. For instance, air or gas can be provided at a velocity of about 0.5 m/s to about 5 m/s.

Figure 37:
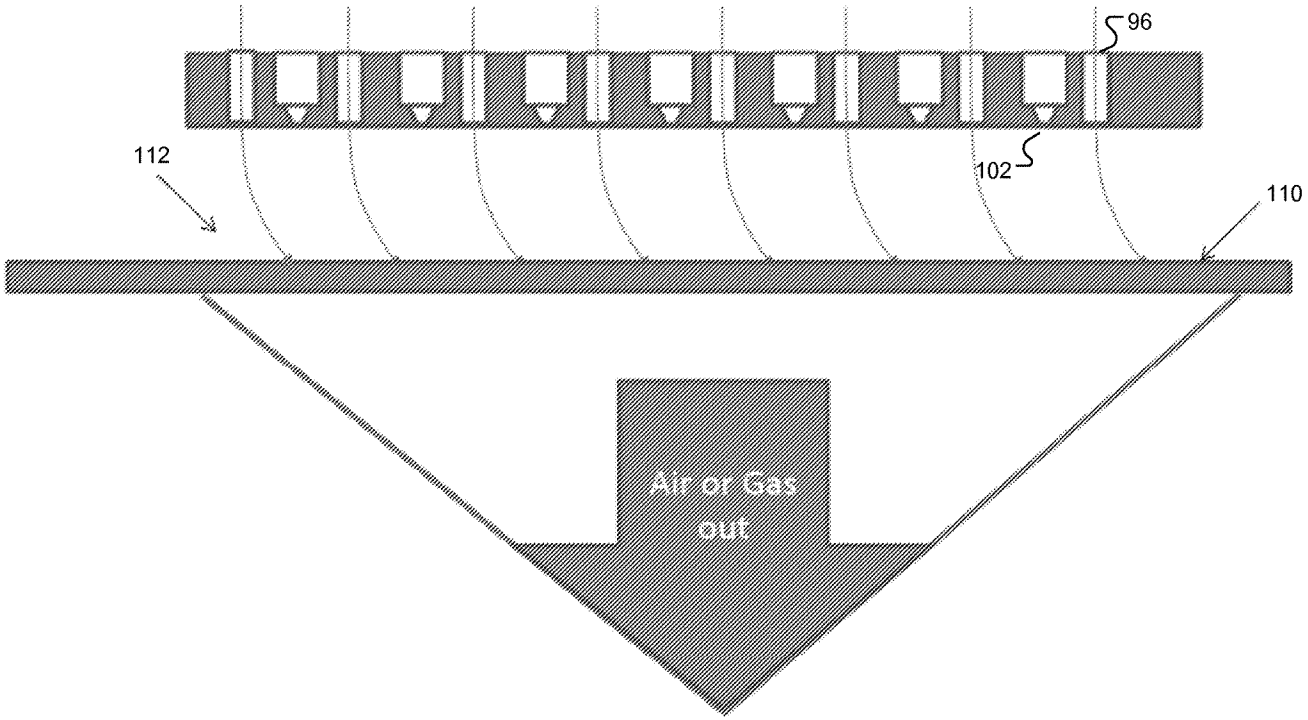
FIG. 37 is a side view of a print head with multiple laminar flow slots.

Referring to FIG. 37, in some embodiments, a suction can be applied to the back side of a porous substrate 110, such as a textile. Suction applied to the back side of a substrate can help develop airflow vertically through the substrate, for instance, to help draw the air flow vertically downward from the laminar flow slots 96. For instance, the substrate 110 can be placed on a vacuum chuck. The suction applied to the back side of the substrate can enhance the flow field established by the gas injected from the laminar flow slots 96. In the example of FIG. 37, a laminar flow slot 96 is provided for each row of nozzles; in some examples, a suction can be applied to enhance the vertical flow field provided by a single laminar flow slot 90. A flow field in the vertical direction reduces the drag forces on the droplets during flight, enabling printing of droplets from a higher height without significant loss of droplet velocity.

Computational fluid dynamics (CFD) simulations of high height ink jet printing were performed to investigate how jetting conditions affect the gas flow under the print head. Simulations were performed using ANSYS® CFX (ANSYS, Canonsburg, Pa.), a fluid dynamics simulation program. The simulations were modeled as a half symmetry model of a 256 jet stationary print head with the nozzles positioned in a single row. The jets of ink drops developed by the drop streams were simulated using a particle tracking model to simulate ejection of 40 ng ink drops at 7 m/s and 8 kHz across a 5 mm gap. To perform the simulations, a mesh was generated by sub-dividing the fluid region into multiple rectangular bodies and meshed with a combination of ANSYS® multi-zone and hex dominant meshing methods. The mesh was refined to a size of 50 μm in the region surrounding the drop paths and gradually increased to a size of 2 mm. The resulting mesh yielded 2.6 M modes and 3.0 M elements.

The model was first solved as a steady state analysis to develop the couette flow under the print head. The substrate was simulated as a wall moving at 0.5 m/s, stationary walls were applied to the print head surfaces, and non-wall surfaces were modeled as openings at 1 atm. The Reynolds number computed with these simulated conditions and with a gap height of 5 mm was 167, which is significantly below the onset of turbulence. Therefore, a laminar flow model was applied.

After convergence of the couette flow solution, particle injections were added at each nozzle location and set to eject 42 μm and 40 ng drops at 7 m/s and 8 kHz. The substrate was configured to absorb all particles to prevent the particles from bouncing off the wall and causing additional disturbances to the flow. Since the flow was determined to be in the laminar flow regime, both experimentally and computationally, the Schiller-Naumann drag model was applied to the particles. The transient simulation was solved for a total time duration of 100 ms using time steps of 1E-5 seconds.

Figure 38:
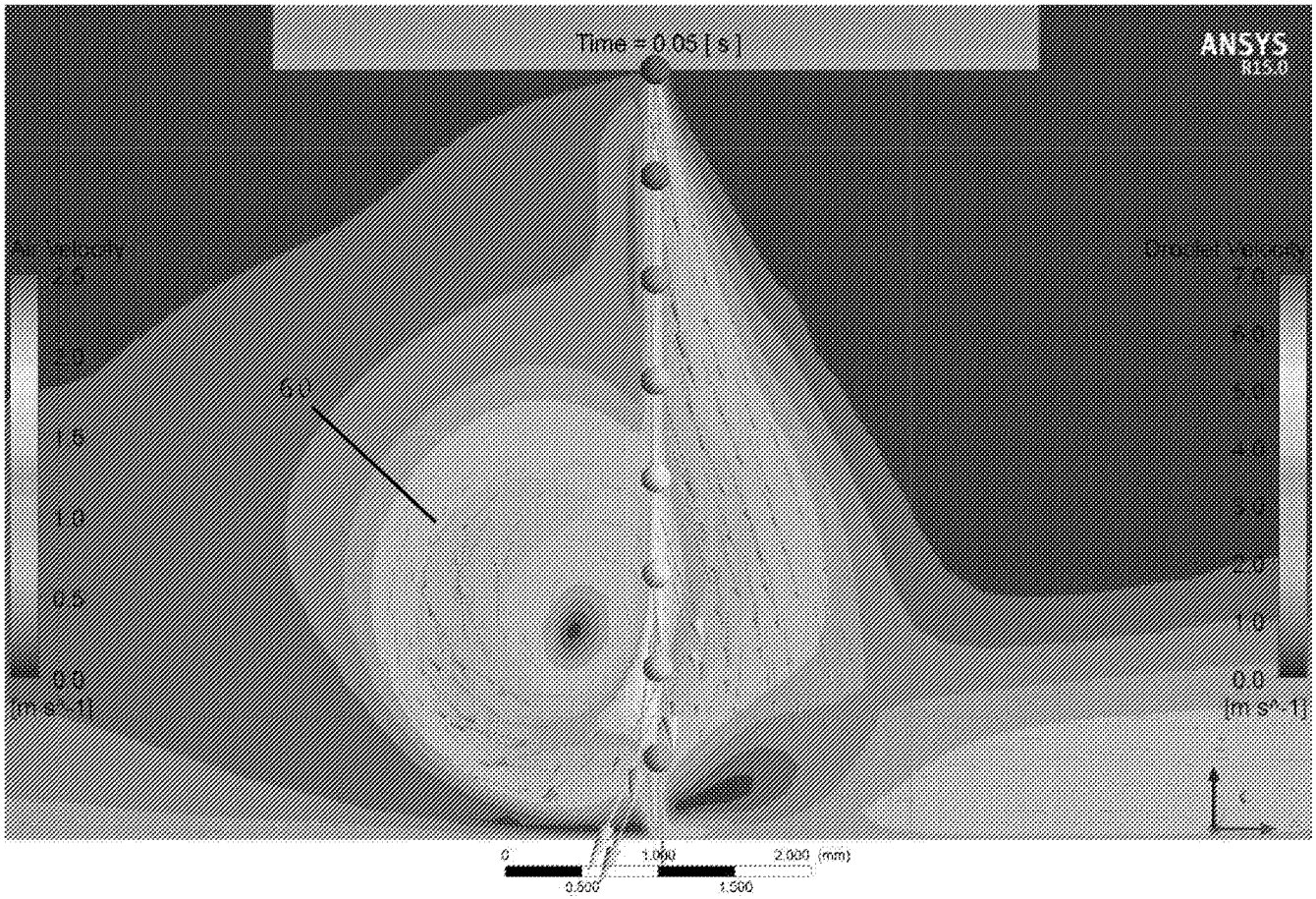
FIGS. 38, 39A, and 39B show results of a computational fluid dynamics simulation.
Figure 39A:
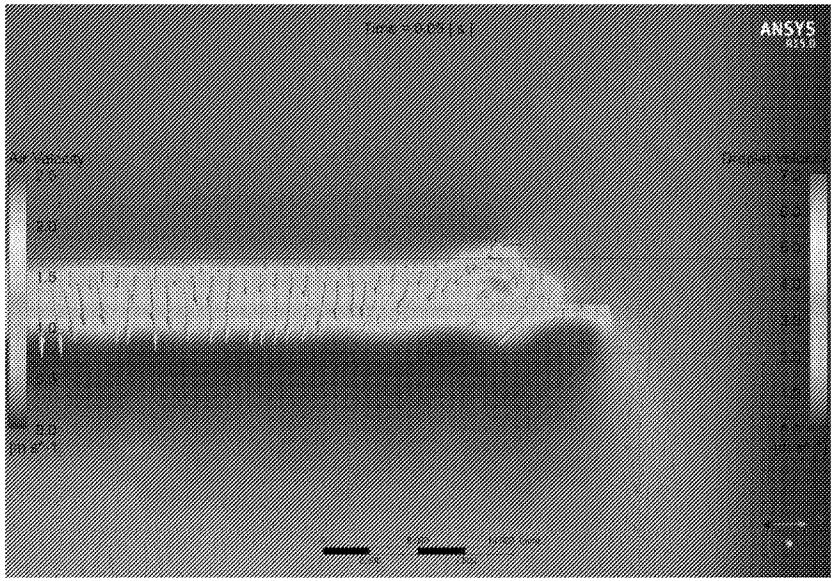
Figure 39B:
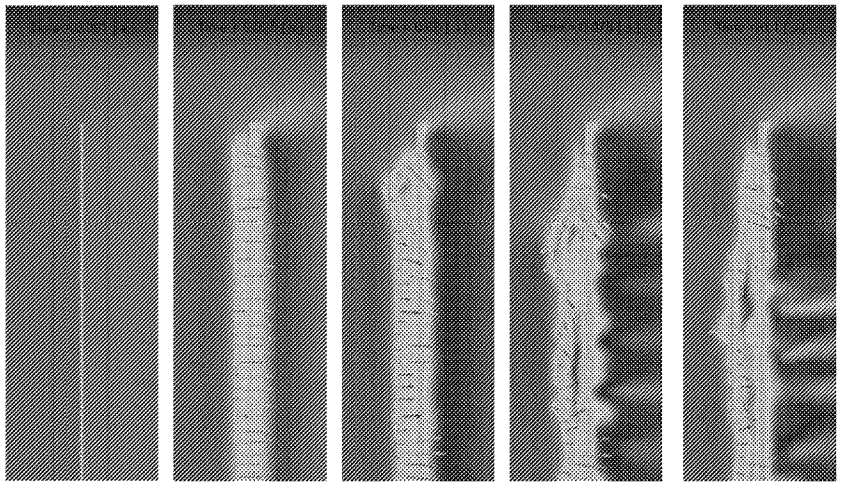

FIG. 38 shows CFD results at t=50 ms, showing that an eddy 60 becomes substantially fully developed in approximately 50 ms. The substrate is simulated as moving left to right. The results of the transient simulation generally confirmed the experimental results described above. Referring also to FIGS. 39A and 39B, as the eddy starts to roll along the length of the droplet curtain, the cross flow begins to initiate forces (visualized as velocity vectors in the CFD results) on the droplets in the cross-process direction. These forces can lead to droplet placement errors that can result in imaging defects, such as those described above. FIG. 39A shows CFD results 3 mm below the print head at t=50 ms and FIG. 39B shows the transient response of the flow 3 mm below the print head for times t=1 ms, 25 ms, 50 ms, 75 ms, and 100 ms.

Figure 40:
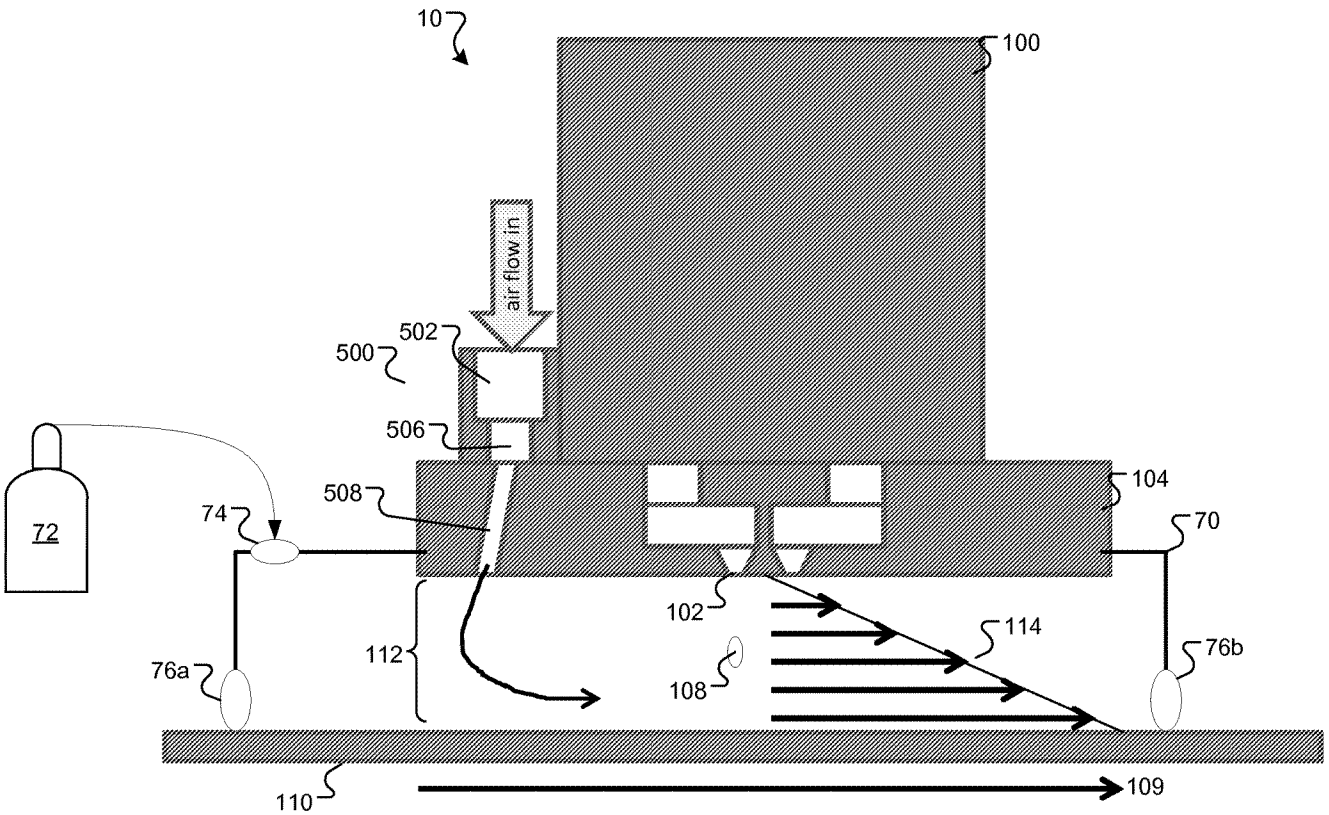
FIG. 40 is a diagram of an ink jet printing system.

Referring to FIG. 40, in some embodiments, high height ink jet printing can be performed in a low density gas environment, such as a helium environment, a low pressure air environment, or a vacuum. For instance, some or all of the print head 100 can be enclosed in a chamber 70 with vacuum, helium, or another low density gas or combination of gases therein. For instance, the chamber 70 can enclose a plate 71 holding the substrate, the print head itself 100, or another portion of the ink jet printing system. Printing in a low density gas environment affords many of the advantages offered by forced low density gas and further result in less waste of the low density gas.

In the example of FIG. 40, the bottom surface of the nozzle plate 104 is contained in a helium environment in the chamber 70. Helium is provided to the interior of the chamber 70 from a gas source 72, such as a gas canister, and the flow of helium into the chamber is controlled by a controller 74, such as a valve or mass flow controller. For instance, the flow of helium can be controlled to maintain a target pressure within the chamber 70. In some examples, the pressure in the chamber 70 can be controlled with a differential pressure measurement to maintain the chamber 70 at a slightly positive pressure relative to the ambient environment. In some examples, a compressor can be used to recycle gas from the low density environment around the substrate and mix the recycled gas with helium from the gas source 72 to achieve a desired mass fraction of helium to air, e.g., a mass fraction of at least about 0.5. The helium-air mixture can be supplied to the gap 112 through the gas supply ports 502.

In some cases, flow restrictors 76*a*, 76*b*, such as brushes or flexible wipers, can be located where the substrate 110 enters into and exits from the chamber 70 to mitigate leakage while still allowing substrates to continuously enter and exit the printing area under the print head 100.

In some examples, the gas flow module 500 can inject a flow of low density gas into the gap 112 between the print head 100 and the substrate 110 to augment the couette flow within the gap 112. The flow control device 500 can include components such as fans, ducts, filters, or screens to provide a controlled flow of gas into the gap. The gas flow module 500 can use recycled gas from the low density gas environment within the chamber 70 to reduce waste. In some examples, no flow of low density gas is provided in the gap.

Referring again to FIG. 2, in some embodiments, the occurrence of wood grain defects, fogging defects, or both can be reduced by adjusting the spacing d between adjacent nozzles 102 in a row 106, the spacing w between adjacent rows 106, or both. In particular, reducing nozzle spacing d while maintaining a consistent native print resolution can reduce the occurrence of wood grain defects. Without being bound by theory, it is believed that as the nozzle spacing increases, the resistance to the flow past the nozzles decreases. This reduced resistance in turn reduces the interaction between the couette flow and the flow entrained by the motion of the droplets, allowing the couette flow to more easily stabilize eddies that may develop in the gap between the print head and the substrate.

To evaluate the effect of nozzle spacing and row spacing on the occurrence of wood grain defects, test images were printed using a linear motor sled printer. An image pattern of 256 lines spaced at 100 dots per inch (dpi) in the cross process direction and 400 dpi in the process direction and 2400 pixels long (6 inches) was printed using various nozzle spacings, printing speeds, and printing frequencies. The images were printed using a black ceramic ink on a 10 mil photo base substrate. Experiments generally used Fujifilm Dimatix (Lebanon, N.H.) QE-30, PQ-M, or QS-40 print heads; certain experiments used SG-1024-MC or SAMBA 3 pl print heads. Primary test parameters for the nozzle spacing experiments were as follows:

Cross-process nozzle spacing (d): 0.25 mm; 0.5 mm
Cross-process print resolution: 100 dpi; 200 dpi; 400 dpi
Process print resolution: 400 dpi
Standoff (h): 2.5 mm-5.1 mm
Droplet ejection velocity: 7 m/s
Frequency: 4-24 kHz
Substrate velocity: 0.25-1.51 m/s
Drop mass: 33-43 ng (native drops); 95-110 ng (multi-pulse)

The drive voltage to jet at 7 m/s was determined for each print head and the drop mass was recorded. The normalized drop mass was used throughout the tests to ensure that each print head was jetting at 7 m/s. In multi-pulse jetting, an actuator in the print head that controls drop ejection from a nozzle is subjected to a rapid succession of electric pulses that results in the ejection of a larger droplet of ink. Multi-pulse jetting enables jetting of different drop sizes from a single nozzle diameter.

Figure 41:
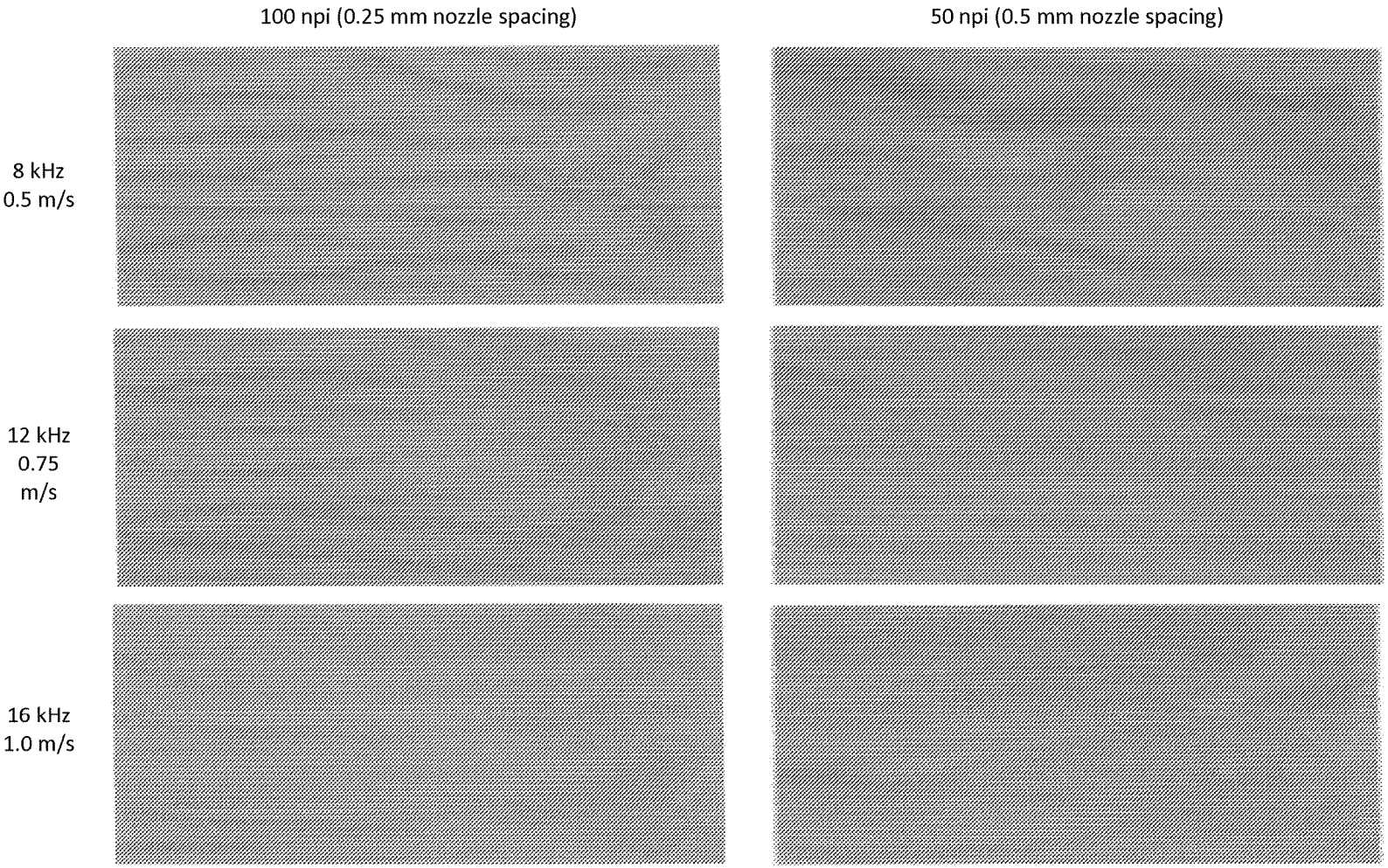
FIG. 41 is a set of images printed using various nozzle spacings.

FIG. 41 shows the effect of cross-process nozzle spacing (d) on the occurrence and severity of wood grain defects for a standoff h of 5.1 mm. (At 0.25 mm nozzle spacing, minor wood grain defects were also observed for a standoff h of 3.5 mm; results not shown.) For each nozzle spacing (0.25 mm and 0.5 mm), combinations of jetting frequency and substrate speed were tested at 4-24 kHz, where each combination achieved a process resolution of 400 dpi (not all results are shown). The images shown in FIG. 41 were printed using QE-30 (100 nozzles per inch (npi)) and PQR-M (50 npi) print heads and the results were validated using QSR-40 (100 npi) and SG1024-MC (50 npi) print heads. The images shown in FIG. 41 demonstrate that, for the same native resolution, increasing the spacing between adjacent nozzles can help alleviate wood grain defects.

The images of FIG. 41 show that the occurrence of wood grain defects diminishes as the substrate velocity and print frequency are increased. For instance, at a substrate velocity of 1 m/s and a frequency of 16 kHz, the occurrence of wood grain defects was significantly reduced. Without being bound by theory, this reduction in wood grain defects at higher substrate velocities and print frequencies is believed to be primarily due to the increased couette flow of gas entrained in the gap by the faster substrate velocity. The droplet drag was not measured to substantially change as jetting frequency increased from 8 to 16 kHz, thus indicating that the frequency of jetting may not have a significant effect on the reduction of wood grain defects.

For instance, in some examples, wood grain defects can be reduced or eliminated by having a nozzle spacing of about 0.5 mm between adjacent nozzles within a row and about 1 mm between adjacent rows of nozzles. Wood grain defects can also be reduced by positioning the rows of nozzles orthogonal to the flow direction, e.g., within about 10 degrees of the flow direction.

Embodiment 1 is directed to a system comprising a print head including multiple nozzles formed in a bottom surface of the print head, the nozzles configured to eject a liquid onto a substrate; and a gas flow module configured to provide a flow of gas through a gap between the bottom surface of the print head and the substrate in a direction corresponding to a motion of the substrate relative to the print head.

Embodiment 2 is directed to embodiment 1, in which the gas flow module comprises one or more gas nozzles configured to inject gas into the gap.

Embodiment 3 is directed to embodiment 2, in which the one or more gas flow nozzles are interleaved with the nozzles.

Embodiment 4 is directed to embodiment 2 or 3, in which the one or more gas flow nozzles comprises an elongated nozzle.

Embodiment 5 is directed to embodiment 4, in which the elongated gas nozzle is disposed at an angle of about 0-45° to the bottom surface of the print head.

Embodiment 6 is directed to embodiment 4 or 5, in which the elongated nozzle is disposed at an angle of about 45-90° to a direction that is perpendicular to a direction of motion of the substrate.

Embodiment 7 is directed to any of embodiments 4 to 6, in which a width of the elongated nozzle is between about 1-8 mm.

Embodiment 8 is directed to any of embodiments 4 to 7, in which each elongated nozzle is disposed substantially parallel to a row of the nozzles formed in the bottom surface of the print head.

Embodiment 9 is directed to any of embodiments 2 to 8, in which at least one of the gas flow nozzles comprises multiple holes.

Embodiment 10 is directed to any of embodiments 2 to 9, in which each gas nozzle is disposed at an angle of about 0-45° to the bottom surface of the print head.

Embodiment 11 is directed to any of embodiments 2 to 10, in which a width of each gas nozzle is between about 1-8 mm.

Embodiment 12 is directed to any of the preceding embodiments, in which the gas flow module is a first gas flow module and further comprising a second gas flow module, and in which the first gas flow module is configured to provide a flow of gas through the gap in a first direction and the second gas flow module is configured to provide a flow of gas through the gap in a second direction opposite the first direction.

Embodiment 13 is directed to embodiment 12, comprising a first valve configured to enable the first gas flow module to provide a flow of gas through the gap; and a second valve configured to enable the second gas flow module to provide a flow of gas through the gap.

Embodiment 14 is directed to embodiment 12 or 13, in which the first gas flow module comprises a first suction module positioned on a first side of the print head and configured to apply suction to the gap; and in which the second gas flow module comprises a second suction module positioned on a second side of the print head opposite the first side and configured to apply suction to the gap.

Embodiment 15 is directed to embodiment 14, in which the first gas flow module comprises one or more first gas flow nozzles positioned on the second side of the print head and configured to inject gas into the gap; and in which the second gas flow module comprises one or more second gas flow nozzles positioned on the first side of the print head and configured to inject gas into the gap.

Embodiment 16 is directed to any of the preceding embodiments, in which the gas flow module is positioned to provide the flow of gas in a direction substantially corresponding to a direction in which the nozzles eject the liquid onto the substrate.

Embodiment 17 is directed to any of the preceding embodiments, in which the gas flow module is configured to provide a flow of gas for each of multiple print heads.

Embodiment 18 is directed to any of the preceding embodiments, in which the gas flow module comprises a connector configured to receive the gas from a gas source.

Embodiment 19 is directed to any of the preceding embodiments, in which the gas flow module is configured to provide a flow of low density gas through the gap.

Embodiment 20 is directed to embodiment 19, in which the low density gas comprises helium.

Embodiment 21 is directed to any of the preceding embodiments, in which the gas flow module is positioned upstream of the nozzles.

Embodiment 22 is directed to any of the preceding embodiments, in which the gas flow module is configured to apply a suction to the gap.

Embodiment 23 is directed to any of the preceding embodiments, in which the gas flow module is positioned downstream of the nozzles.

Embodiment 24 is directed to embodiment 23, in which the gas flow module is positioned such that a gas flow path through the gas flow module is lower than a gas flow path through the gap.

Embodiment 25 is directed to embodiment 23 or 24, in which the gas flow module is wider than a bottom surface the print head.

Embodiment 26 is directed to any of embodiments 23 to 25, in which a lateral edge of the gap is sealed along at least a portion of the print head.

Embodiment 27 is directed to any of the preceding embodiments, in which the gas flow module is a first gas flow module positioned upstream of the nozzles, and in which the system includes a second gas flow module positioned downstream of the nozzles.

Embodiment 28 is directed to any of the preceding embodiments, in which the gas flow module is a first gas flow module configured to inject a gas into the gap, and in which the system includes a second gas flow module configured to apply a suction to the gap.

Embodiment 29 is directed to any of the preceding embodiments, in which the gap between the bottom surface of the print head and the substrate is at least about 3 mm.

Embodiment 30 is directed to any of the preceding embodiments, in which the gap between the bottom surface of the print head and the substrate is at least about 5 mm.

Embodiment 31 is directed to any of the preceding embodiments, comprising one or more of an inlet baffle disposed at an entrance to the gap or an outlet baffle disposed at an exit from the gap.

Embodiment 32 is directed to embodiment 31, in which a length of the inlet baffle, the outlet baffle, or both is at least five times greater than a height of the gap between the bottom surface of the print head and the substrate.

Embodiment 33 is directed to any of the preceding embodiments, comprising a suction generator configured to apply a suction to a back side of the substrate.

Embodiment 3444 is directed to any of the preceding embodiments, in which the gas flow module is configured to provide a flow of gas at a velocity of between about 0.25 m/s and about 1.5 m/s in a region of the gap substantially at a midpoint between the bottom surface of the print head and the substrate.

Embodiment 35 is directed to any of the preceding embodiments, in which the gas flow module is configured to provide a flow of gas at a velocity having a uniformity within 20% along a length of the print head.

Embodiment 36 is directed to any of the preceding embodiments, in which the gas flow module comprises a diffuser through which the gas flows prior to entering the gap.

Embodiment 37 is directed to embodiment 36, in which the diffuser comprises a serpentine channel.

Embodiment 38 is directed to embodiment 36 or 37, in which the diffuser comprises a porous material.

Embodiment 39 is directed to a system comprising a print bar configured to receive multiple print heads, the print heads configured to print a liquid onto a substrate; and a gas flow module configured to provide a flow of gas through a gap between the a bottom surface of each print head and the substrate in a direction corresponding to a motion of the substrate relative to the print head.

Embodiment 40 is directed to embodiment 39, comprising the multiple print heads attached to the print bar.

Embodiment 41 is directed to embodiment 40, in which the print bar includes a non-printing region between an edge of the print bar and a location on the print bar configured to receive an outermost print head.

Embodiment 42 is directed to any of embodiments 39 to 41, in which the gas flow module comprises an elongated nozzle.

Embodiment 43 is directed to any of embodiments 39 to 42, in which the gas flow module is formed in the print bar.

Embodiment 44 is directed to any of embodiments 39 to 43, in which the gas flow module is configured to inject a gas into the gap.

Embodiment 45 is directed to any of embodiments 39 to 44, in which the gas flow module is configured to apply a suction to the gap.

Embodiment 46 is directed to any of embodiments 39 to 45, in which the gas flow module is a first gas flow module positioned upstream of the print heads, and in which the system includes a second gas flow module positioned downstream of the print heads.

Embodiment 47 is directed to any of embodiments 39 to 46, in which the gas flow module is a first gas flow module configured to inject a gas into the gap, and in which the system includes a second gas flow module configured to apply a suction to the gap.

Embodiment 48 is directed to any of embodiments 39 to 47, in which the gas flow module is configured to provide a flow of gas at a velocity having a uniformity within 20% along a length of the print bar.

Embodiment 49 is directed to any of embodiments 39 to 48, in which the gas flow module is positioned such that a gas flow path through the gas flow module is lower than a gas flow path through the gap.

Embodiment 50 is directed to any of embodiments 39 to 49, in which the gas flow module is wider than a bottom surface of the print bar.

Embodiment 51 is directed to any of embodiments 39 to 50, in which a lateral edge of the gap is sealed along at least a portion of the print bar.

Embodiment 52 is directed to any of embodiments 39 to 51, in which the system comprises multiple print bars; and multiple gas flow modules, wherein each gas flow module corresponds to one of the multiple print bars.

Embodiment 53 is directed to a method comprising providing a flow of a low density gas through a gap between a bottom surface of a print head and a substrate; and ejecting a liquid through the gap and onto the substrate from multiple nozzles formed in the bottom surface of the print head.

Embodiment 54 is directed to embodiment 53, in which the low density gas comprises helium.

Embodiment 55 is directed to embodiment 53 or 54, in which providing the low density gas comprises flowing the low density gas through the gap.

Embodiment 56 is directed to embodiment 55, comprising flowing the low density gas in a direction corresponding to a motion of the substrate relative to the print head.

Embodiment 57 is directed to embodiment 55 or 56, comprising flowing the low density gas through one or more of an inlet baffle disposed at an entrance to the gap or an outlet baffle disposed at an exit from the gap.

Embodiment 58 is directed to any of embodiments 53 to 57, in which providing the low density gas comprises ejecting the low density gas from one or more gas nozzles into the gap.

Embodiment 59 is directed to any of embodiments 53 to 58, in which providing the low density gas comprises disposing the bottom surface of the print head in an environment containing the low density gas.

Embodiment 60 is directed to any of embodiments 53 to 59, comprising applying a suction to the gap.

Embodiment 61 is directed to any of embodiments 53 to 60, comprising applying a suction to a back side of the substrate.

Embodiment 62 is directed to any of embodiments 53 to 61, in which providing a flow of gas comprises providing a flow of gas at a velocity of between about 0.25 m/s and about 1.5 m/s in a region of the gap substantially at a midpoint between the bottom surface of the print head and the substrate.

Embodiment 63 is directed to any of embodiments 53 to 62, in which providing a flow of gas comprises providing a flow of gas at a velocity having a uniformity within 20% along a length of the print head.

Embodiment 64 is directed to any of embodiments 53 to 63, in which providing a flow of gas through the gap comprises providing a flow of gas in a first direction through the gap when the print head moves in the first direction relative to the substrate; and providing a flow of gas in a second direction through the gap when the print head moves in the second direction relative to the substrate, the second direction opposite the first direction.

It is to be understood that the foregoing description is intended to illustrate and not limit the scope of the invention, which is defined by the scope of the appended claims. Other implementations are also within the scope of the following claims.

What is claimed is:

1. A system comprising:

a print head including multiple nozzles formed in a bottom surface of the print head, the nozzles configured to eject a liquid onto a substrate;

a gas flow module configured to provide a flow of gas through a gap between the bottom surface of the print head and the substrate in a direction corresponding to a motion of the substrate relative to the print head, the gas flow module including:

a flow control device distinct from the print head, the flow control device configured to control one or more of a velocity and a uniformity of the flow of gas through the gap.

2. The system of claim 1, in which the gas flow module comprises one or more gas nozzles configured to inject gas into the gap.

3. The system of claim 2, in which each of the one or more gas nozzles is disposed at an angle of about 0-45° to the bottom surface of the print head.

4. The system of claim 1, in which the gas flow module is a first gas flow module and further comprising a second gas flow module, and in which the first gas flow module is configured to provide a flow of gas through the gap in a first direction and the second gas flow module is configured to provide a flow of gas through the gap in a second direction opposite the first direction.

5. The system of claim 4, comprising:

a first valve configured to enable the first gas flow module to provide a flow of gas through the gap; and a second valve configured to enable the second gas flow module to provide a flow of gas through the gap.

6. The system of claim 4, in which the first gas flow module comprises a first suction module positioned on a first side of the print head and configured to apply suction to the gap; and in which the second gas flow module comprises a second suction module positioned on a second side of the print head opposite the first side and configured to apply suction to the gap.

7. The system of claim 1, in which the gas flow module is configured to provide a flow of low density gas through the gap.

8. The system of claim 1, in which the gas flow module is positioned upstream of the nozzles.

9. The system of claim 1, in which the gas flow module is configured to apply a suction to the gap.

10. The system of claim 1, in which the gas flow module is positioned downstream of the nozzles.

11. The system of claim 10, in which a lateral edge of the gap is sealed along at least a portion of the print head.

12. The system of claim 1, in which the gas flow module is a first gas flow module positioned upstream of the nozzles, and further comprising a second gas flow module positioned downstream of the nozzles.

13. The system of claim 1, in which the first gas flow module is a first gas flow module configured to inject a gas into the gap, and further comprising a second gas flow module configured to apply a suction to the gap.

14. The system of claim 1, in which the gap between the bottom surface of the print head and the substrate is at least about 3 mm.

15. The system of claim 1, in which the gas flow module is configured to provide a flow of gas at a velocity of between about 0.25 m/s and about 1.5 m/s in a region of the gap substantially at a midpoint between the bottom surface of the print head and the substrate.

16. The system of claim 1, in which the gas flow module is configured to provide a flow of gas at a velocity having a uniformity within 20% along a length of the print head.

17. The system of claim 1, in which the gas flow module comprises a diffuser through which the gas flows prior to entering the gap.

18. The system of claim 1, in which the flow control device comprises a diffuser.

19. The system of claim 18, in which the diffuser comprises one or more of a serpentine channel and a porous material.

20. The system of claim 1, in which the flow control device comprises a baffle.

21. The system of claim 20, in which a length of the baffle is at least five times greater than a height of the gap.

22. The system of claim 1, in which the flow control device comprises a plenum.

23. The system of claim 22, in which the plenum comprises an elongated opening.

24. The system of claim 1, in which a width of the gas flow module in a direction perpendicular to the direction of motion of the substrate relative to the print head is greater than a width of the print head in the direction perpendicular to the direction of motion of the substrate relative to the print head.

25. The system of claim 24, in which the width of an inlet of the gas flow module is at least about 4 mm greater than the width of the print head.

26. A system comprising:

a print bar configured to receive multiple print heads, the print heads configured to print a liquid onto a substrate; and a gas flow module configured to provide a flow of gas through a gap between a bottom surface of each print head and the substrate in a direction corresponding to a motion of the substrate relative to the print head, the gas flow module including:

a flow control device distinct from the multiple print heads, the flow control device configured to control one or more of a velocity and a uniformity of the flow of gas through the gap.

27. The system of claim 26, in which the print bar includes a non-printing region between an edge of the print bar and a location on the print bar configured to receive an outermost print head.

28. The system of claim 26, in which the gas flow module is formed in the print bar.

29. The system of claim 26, in which the gas flow module is configured to inject a gas into the gap.

30. The system of claim 26, in which the gas flow module is configured to apply a suction to the gap.

31. The system of claim 26, in which the gas flow module is a first gas flow module positioned upstream of the print heads, and further comprising a second gas flow module positioned downstream of the print heads.

32. The system of claim 26, in which the gas flow module is a first gas flow module configured to inject a gas into the gap, and further comprising a second gas flow module configured to apply a suction to the gap.

33. The system of claim 26, in which the gas flow module is configured to provide a flow of gas at a velocity having a uniformity within 20% along a length of the print bar.

34. The system of claim 26, in which the system comprises:

multiple print bars; and multiple gas flow modules, wherein each gas flow module corresponds to one of the multiple print bars.

35. The system of claim 26, in which a width of the gas flow module in a direction perpendicular to the direction of motion of the substrate relative to the print head is greater than a width of the print bar in the direction perpendicular to the direction of motion of the substrate relative to the print head.

* * * * *